US010625920B1

(12) United States Patent
Sadaghiani

(10) Patent No.: US 10,625,920 B1
(45) Date of Patent: Apr. 21, 2020

(54) DRY PURGE DESICCATOR AND METHOD

(71) Applicant: Terra Universal, Inc., Fullerton, CA (US)

(72) Inventor: Kamran Sadaghiani, Fullerton, CA (US)

(73) Assignee: TERRA UNIVERSAL, INC., Fullerton, CA (US)

( * ) Notice: Subject to any disclaimer, the term of this patent is extended or adjusted under 35 U.S.C. 154(b) by 0 days.

(21) Appl. No.: 16/222,896

(22) Filed: Dec. 17, 2018

Related U.S. Application Data

(62) Division of application No. 15/387,432, filed on Dec. 21, 2016, now Pat. No. 10,246,240.
(Continued)

(51) Int. Cl.
*B65D 81/26* (2006.01)
*F26B 25/12* (2006.01)
(Continued)

(52) U.S. Cl.
CPC ..... *B65D 81/263* (2013.01); *F26B 5/00* (2013.01); *F26B 9/066* (2013.01); *F26B 21/14* (2013.01); *F26B 25/12* (2013.01)

(58) Field of Classification Search
CPC .. F26B 25/12; F26B 5/00; F26B 9/066; F26B 21/08; F26B 3/347; F26B 21/14; F26B 21/06; B65D 81/263
(Continued)

(56) References Cited

U.S. PATENT DOCUMENTS 3,417,486 A 12/1968 Vanicek
4,442,143 A 4/1984 Reed
(Continued)

FOREIGN PATENT DOCUMENTS

WO WO 2009/048908 4/2009

OTHER PUBLICATIONS

Thomas Industries, Desiccator Cabinet Provides Pressurized Storage Space, Press Release Summary website printout, Nov. 13, 2003, 5 pages, Minneapolis, MN, USA.
(Continued)

*Primary Examiner* — Stephen M Gravini
(74) *Attorney, Agent, or Firm* — John J. Connors; Connors & Assoc. pc

(57) ABSTRACT

My desiccator comprises a plurality of chambers in series communication with each other so a desiccating gas flows from one chamber into an adjacent chamber. A desiccating purge gas is introduced through an inlet into the desiccator's chambers at a predetermined flow rate, and a one-way bleed valve allows gas within the chambers to constantly flow from the desiccator while maintaining a positive pressure within the desiccator. A fan that constantly mixes and circulates the gas between the chambers as the desiccating purge gas is introduced into the desiccator, constantly diluting the gas within the chambers with a fresh supply of the desiccating gas. My method employs my desiccator to store items, wherein a dry, pressurized desiccating gas is introduced into the desiccator's chambers in a manner that constantly circulates the gas between the chambers as gas is slowly bled from the chambers, constantly diluting the gas within the chambers with a fresh supply of the desiccating gas. In my method the dew point of the desiccating gas is from −20 to −90 F°, the pressure of the desiccating gas is from 30 to 120 psi, and the average flow rate of the desiccating gas into the desiccator is from 0.25 to 4.0 cubic feet per minute.

3 Claims, 29 Drawing Sheets

Related U.S. Application Data

(60) Provisional application No. 62/271,218, filed on Dec. 22, 2015.

(51) Int. Cl.
*F26B 21/14* (2006.01)
*F26B 9/06* (2006.01)
*F26B 5/00* (2006.01)

(58) Field of Classification Search
USPC ..... 34/218
See application file for complete search history.

(56) References Cited

U.S. PATENT DOCUMENTS

| | | | | |
|---|---|---|---|---|
| 5,105,558 | A | 4/1992 | Curry | |
| 5,651,193 | A | 7/1997 | Rhodes | |
| 5,809,664 | A | 9/1998 | Legros | |
| 6,268,012 | B1 | 7/2001 | Sikora | |
| 7,018,201 | B1 | 3/2006 | Pierce | |
| 7,479,176 | B2 | 1/2009 | Crawford | |
| 10,240,867 | B2 * | 3/2019 | Zielinski | F26B 5/04 |
| 10,246,240 | B1 | 4/2019 | Sadaghiani | |
| 2018/0209123 | A1 * | 7/2018 | Bahrami | B01D 5/006 |
| 2019/0254243 | A1 * | 8/2019 | Friesen | A01G 31/02 |
| 2019/0280318 | A1 * | 9/2019 | Friesen | H01M 8/04171 |

OTHER PUBLICATIONS

Pac Production Automation Corporation , Palbam Class N2 Desiccator Cabinets, Desiccators: Unique Stainless Steel Solutions from Palbam Class, website printout, 2018 Eden Prair.
Dry Cabinets and Storage, Dry Cabinets and Storage, Most Popular Desiccator Cabinets, Shop by Brand, Advanced Desiccator Options, website printout, Jul. 24, 2018.
Cypress Seminconductor Corporation, Long Term Storage of Water and Dye Semiconductor IC Products, AN98505 2001-2018, San Jose, CA, USA.
Pac Production Automation Coporation, Manufacturing Uses of Desiccator, website printout, 21 pages, 2018, Eden Prairie, MN, USA.
Totech Shanghai Co., Ltd, Our New Website Is Now Live, website printout, 3 pages, Copyright 2010-2020, Shanghai, China.
Creatie Works Industrial Design & Internet Marketing, Standard Desiccator Cabinets, 3pages, website printout, Copyright 2018 Clean Air Products, Minneapolis, MN, USA.
Plas Labs, Inc. Desiccators, Multiple Cubicle Desiccators, website printout, 5 pages.
Sti; Systems and Technology International, Inc., Desiccator Cabinets and Dry Boxes, 3 pages, website printout Copyright 2018 Systems Technology, Intl, Inc.
Terra universal.com, Critical Environmental Solutions, Kamran Sadaghiani, IsoDry Nitrogen Purge Desiccator Cabinet Inventor's Statement, Jun. 27, 2018, 2 pages, Fullerton, CA.
U.S. Appl. No. 16/222,916, filed Dec. 2018, Sadaghiani.

* cited by examiner (PRIOR ART)

(PRIOR ART)

DOOR SENSOR (DS)

REAR VIEW

FRONT VIEW

TOP PANEL

PLENUM

REAR PANEL

Fig. 23
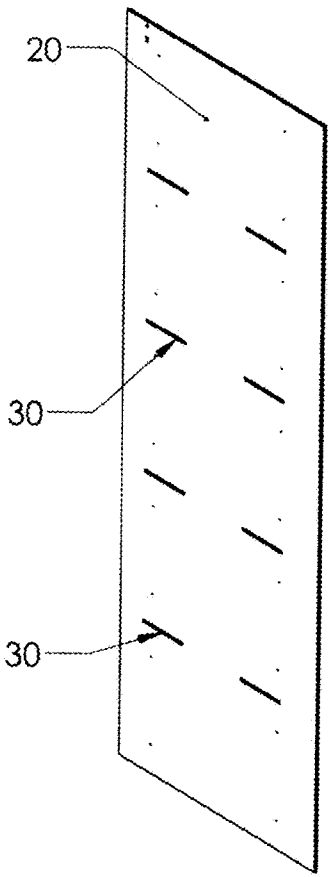
LEFT BODY
Fig. 22
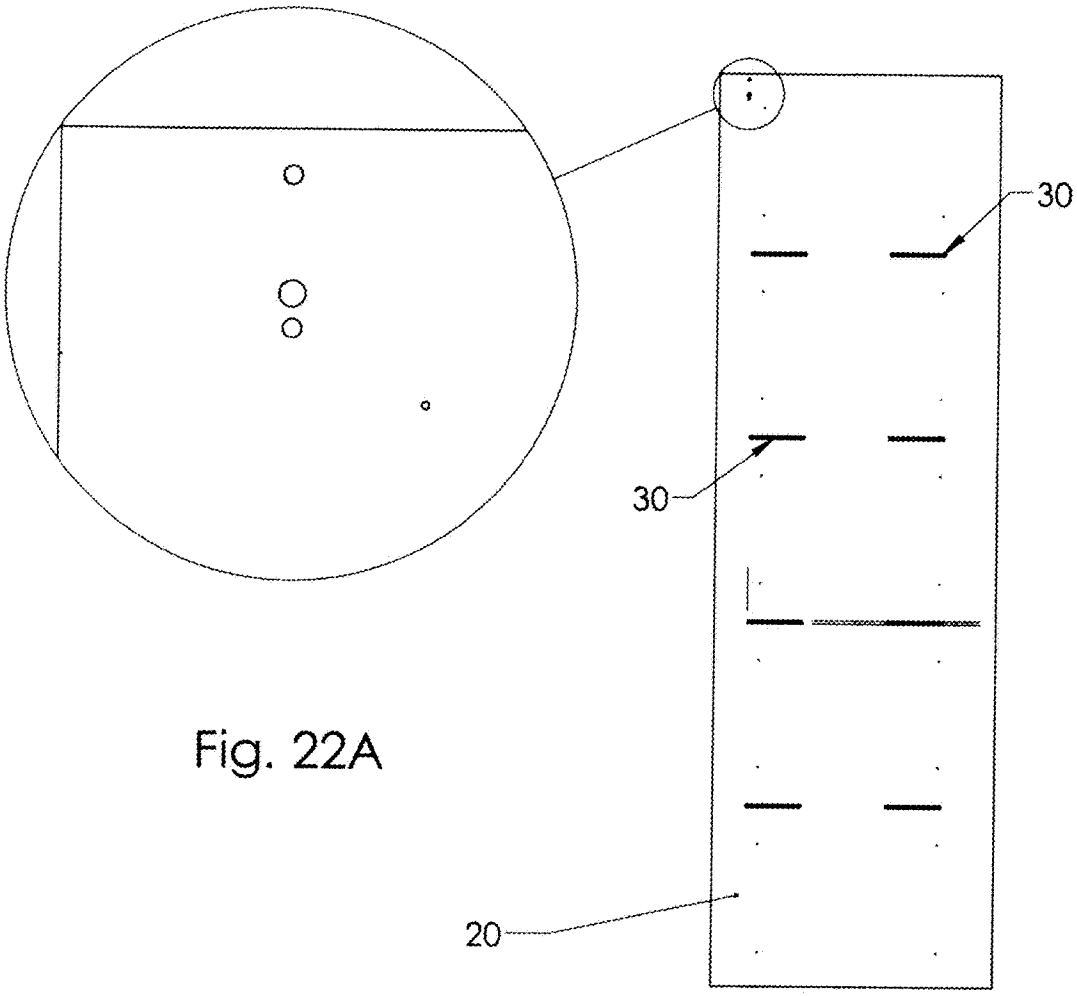
LEFT PANEL INSIDE VIEW
Fig. 22A

RIGHT PANEL

RIGHT PANEL $N_2$ Pressure: 60psi Volume: 9.3 $ft^3$ $N_2$ Rate: 130 SCFH

Configuration: 1/4" nitrogen line ran from Humidity Module to the bottom chamber. Door was open for 10 seconds at 67 minutes from the start of the test.

$N_2$ Pressure: 60psi Volume: 9.8 $ft^3$ $N_2$ Rate: 130 SCFH

Configuration: 1/4" nitrogen line ran from Humidity Module to rear plenum. Chambers connected in paralled to plenum. Chamber 1 was open for 10 seconds at 67 minutes from the start of the test.

Fig. 34

| Efficiency Comparison Container Volume: 9.8 $ft^3$ Flow Rate: 2 $ft^3$ | | | | |
|---|---|---|---|---|
| Air Circulation (CFM) | Time | N2 Consumed ($ft^3$) | Purge speed Increase | |
| 0 | 19.0 | 38.0 $ft^3$ | 0.00% | Achieving 10 RH% |
| 15 | 13.3 | 26.6 $ft^3$ | 42.85% | |
| 30 | 9.8 | 19.6 $ft^3$ | 93.88% | |
| 90 | 8.5 | 17.0 $ft^3$ | 123.53% | |
| 0 | 70.7 | 141.4 $ft^3$ | 0.00% | Achieving 5 RH% |
| 15 | 28.7 | 57.4 $ft^3$ | 141.82% | |
| 30 | 18.3 | 36.6 $ft^3$ | 286.34% | |
| 90 | 14.8 | 29.6 $ft^3$ | 377.70% | |

One chamber Two Chambers Three Chambers Four Chambers Five Chambers

Six Chambers Seven Chambers Eight Chambers

Fig. 38

| PART DESCRIPTION | QTY | IMAGE |
|---|---|---|
| PC<br>Power connector | X1 | |
| 14<br>Connector, male, brass 1/4" tubing O.D. | X2 | |
| F<br>Air Circulation Fan 4.69" Square 1" Depth 12 Volts DC 110 CFM | X2 | |
| 11<br>Fan Guard 4.69" | X2 | |
| HS<br>Nitrowatch RH Sensor | X1 | |
| BV<br>RB Valve | X2 | |

| PART DESCRIPTION | QTY | IMAGE |
|---|---|---|
| 15<br>Electropolished Rack for removable shelves | X10 | |
| DS<br>Door Magnet | x5 | |
| 13<br>Lift Latch Keyway | x5 | |
| DM<br>Door Sensor Switch | x5 | |
| SC1<br>5 Pin RH Sensor connector | X1 | |
| SC2<br>Door sensor connector jack, 4 pin | X1 | |
| GB<br>Ground Bar | X1 | |

DRY PURGE DESICCATOR AND METHOD

INCORPORATION BY REFERENCE

This application is a divisional utility application of U.S. Utility patent application Ser. No. 15/387,432, entitled "Dry Purge Desiccator and Method," filed Dec. 21, 2016; which claims the benefit under 35 USC 119(e) of U.S. Provisional Patent Application No. 62/271,218, entitled "Dry Purge Desiccator and Method," filed Dec. 22, 2015. These related applications are incorporated herein by reference and made a part of this application. If any conflict arises between the disclosure of the invention in this divisional utility application and that in the related non-provisional and provisional applications, the disclosure in this divisional utility application shall govern. Moreover, any and all U. S. patents, U.S. patent applications, and other documents, hard copy or electronic, cited or referred to in this application are incorporated herein by reference and made a part of this application.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

The word "rectangular" includes square.

BACKGROUND

Nitrogen-purged storage desiccators provide a clean, dry storage environment for stored, moisture-sensitive items. Configured for use with a nitrogen purge gas flow controller, such as one sold by Terra Universal, Inc. of Fullerton, Calif., under the name ISODRY™, desiccators provide a continuous purge of clean, dry nitrogen to flush out moisture-laden air.

For decades, desiccator storage has been a common practice in many industries, including semiconductor, electronics, aerospace and medical device manufacturing. As critical components become smaller and more sophisticated, their susceptibility to moisture damage increases. In recent years, desiccators have been widely used in bio-pharmaceutical manufacturing to inhibit moisture-related degradation of drugs and biological samples. Once absorbed by sensitive components, water creates a number of potentially disastrous conditions with costly effects. Even minute traces of oxidation, the most notorious result of moisture exposure, can degrade soldering and other manufacturing processes. Because water dissolves ionic contaminants, it also alters the conductivity of the material, which in turn can degrade electrical function. Water also combines with other materials, causing harmful chemical reactions that degrade pharmaceutical samples and chemical mixtures.

One common method of dealing with moisture contamination is to remove it prior to each manufacturing step. Although vacuum processing and bake-and-bag methods of sample drying accomplish this end, these operations slow down production, particularly if they must be repeated several times in the course of circuit manufacturing. Further, these baking and sealing processes themselves expose parts to thermal extremes that can cause damage.

Desiccant dryers avoid some of these drawbacks, but introduce others. Such desiccant dryers remove moisture from air (or other process gas) inside the desiccator chamber and often feature dual module designs that perform online drying and offline desiccant regeneration simultaneously for continuous operation. Such dryers can be effective, but they require heating/drying components that may not be reliable or that may affect stored components. It can take many hours to reduce ambient conditions to a relative humidity of ten percent water vapor at room temperature. Their complexity and high operating costs makes them prohibitively expensive for long-term storage applications.

As an alternative to desiccant dryers, nitrogen-purged desiccator systems maintain dry conditions relatively cheaply and conveniently. The fundamental principle of nitrogen-purged desiccator cabinets is to displace moist air with nitrogen gas. Such systems employ one or more chambers in which the moisture-sensitive content is stored. A continuous purge of nitrogen gas continuously enters the cabinet, displacing any water vapor, and exits through an exhaust valve preferably on a side opposite a gas inlet. Displacement (sweeping), which depends on laminar flow, is the common method employed, although some mixing may be achieved. Consequently, the current technologies discussed above fail to achieve laminar flow effectively. The concept, design, and construction of conventional nitrogen purge desiccators thus incorporate conflicting technologies of displacement and mixing, resulting in inefficiencies.

Figure A depicts a prior art desiccator a having a single displacement channel DC, where dry nitrogen gas $N_2$ is released into the highest chamber 1, to be distributed in a downward flow of gas through the stacked-up vertical chambers 1-5. This is the most common and believed to be the most economical configuration for desiccators. The chambers 1-5 are connected in series and in communication with one another through perforations P in the floors FL of the chambers 1-4, so gas flows in series from a higher chamber into a lower chamber. The nitrogen gas $N_2$ entering the highest chamber 1 moves downward mixing with the moist air in the chambers 1-4. The most basic configuration utilizes a manually-adjusted gas inlet connected to a flow meter FM. Upgraded models of the flow meter FM use an automatically controlled humidity module in which the user can specify a predetermined humidity set point as a percent of water vapor (RH %). When a humidity sensor (not shown) detects a moisture reading above the set point, a solenoid (not shown) opens a valve to release purge gas until the relative humidity set point is reached.

As shown in Figure A, the dry nitrogen gas $N_2$ is flushed into the series of chambers 1-5 from a single point inlet I to displace humid air through a single point outlet O. The chambers 1-5 are in communication with each other so gas flows in series from one chamber to the next. The graph of FIG. 26 shows the performance and concentrations of moisture within each chamber of Figure A. As shown in the graph of FIG. 26, humidity concentrations are not uniform. Furthermore, the humidity sensor (not shown) for the nitrogen purge controller may sometimes provide a misleading impression of the desiccator's overall humidity. Thus, the purge cycle may be discontinued prematurely. FIG. 27 shows the performance and concentrations of moisture within each chamber 1-5 shown in Figure A. The fluctuation shown in the graph of FIG. 27 seen in chamber 5 is a result of a controller unit (not shown) shutting on and off.

Figure B depicts a prior art, multi-chambered desiccator b where the humidity of each chamber 1-5 is purged with dry nitrogen gas $N_2$ by sweeping the purge gas through individual chambers 1-5 in an attempt to achieve a laminar flow. In this embodiment humidity=concentrations are not uniform within the individual chambers. In order to maximize displacement efficiency, a perforated plenum chamber PC1 is utilized to provide a continuous, uniform gas flow to individual chambers. The chambers are connected in parallel with gas flow. They are not in communication with one another through their solid floors FL, and because of the positive pressure of the gas in the plenum chamber PC1, the gas does not flow between the chambers. Current state of the art designs utilize a door sensor DS (FIG. 6) on each door D of the chambers 1-5. The door sensor DS actuates a high-pressure purge whenever a door D is opened. The positive pressure within the chambers 1-5 inhibits moisture or contaminants from entering a chamber as gas flows out an open door D. For critical environment applications, multi-channel purge controllers are available, where each chamber has its own sensor and purge controller.

Failures Encountered by the Prior Art:

FAILURE TO DISPLACE: Typically, desiccators at lower humidity use a direct nitrogen purge to flush out moisture by displacement. However, displacement is an idealized concept. Where purging by displacement may be effective for piping or simple geometries, a desiccator cabinet with shelves stocked with content creates many dead end cavities. A laminar flow system also requires that gas be introduced uniformly across a broad area, creating a piston-like displacing force that is impossible to achieve in a desiccator, even one with a rear plenum wall. Because of this, the moisture-laden air is not effectively displaced. It is common that the purge gas plume can stream or arch from the inlet to the release valve and fails to displace or mix with moisture-laden air, resulting in a slow process.

UNEVEN GAS DISTRIBUTION: Even with perforated plenums, chambers still continue to receive unequal gas distribution, which inhibits rapid recovery times to achieve uniform humidity throughout all the chambers. This problem with prior art desiccators is illustrated by the graphs shown in FIGS. 26, 27 and 28.

SLOW AIRFLOW VELOCITY: Currently, the only applied method to reach dead end cavities is by increasing the velocity of gas plume thereby increasing the sweeping action. In conventional airflow systems, the sweeping action of the purge gas depends on the inlet velocity and direction, which are slow and inefficient, and on uniform gas exhaust, which requires multiple bleed valves that reduce internal positive pressure.

i. Gas flow of 50-200 Standard Cubic Feet per Hour (SCFH) distributed across multiple chambers does not provide adequate airflow to mix or uniformly displace induced content across the cross sectional area of the desiccator.
ii. The effectiveness of reaching dead end cavities depends on purge gas velocity and direction.
iii. Slow inlet velocity inhibits turbulence needed to mix purge gas with water vapor in dead-end cavities.
iv. Nitrogen gas is neutrally buoyant. This means that it is almost the same density as air.
v. Neutrally buoyant gases do not have any intrinsic movement of either up or down and therefore must be driven by an artificial air stream in order to be mixed quickly. And hence an ineffective medium to perform the sweeping action required by displacement at slow velocities.
vi. The lighter the purge gas, the more velocity is required to effectively mix with the induced content.
vii. Unassisted gas diffusion is slow and takes a long time to reach an equilibrium concentration.
viii. The turbulence created from the gas line air stream is not enough to assist the mixing of the water vapor dilution process within a large container.
ix. Slow gas velocity reduces the effectiveness of sweeping out moisture depends on the direction and velocity of the gas plume.
x. A high gas purge of 50-200 SCFH distributed across perforated plenum wall does not create an adequate gas flux for laminar purging.

Type of Problems Encountered in the Prior Art:

ACHIEVING SET POINT QUICKLY: End users frequently complain that nitrogen-purged desiccators do not achieve low-humidity set-points fast enough for moisture-sensitive content. Users must achieve set-point as fast and as efficiently as possible to either reduce wasteful gas consumption or to minimize the amount of time contents are exposed to moisture or oxygen. Unfortunately, the displacement model requires relatively high flow and therefore high gas consumption.

RECOVERY TIME: A major concern in nearly all industries is a desiccator's ability to recover the humidity set point quickly after a chamber is accessed (i.e., its door is opened and closed). Once the door is closed, users need the chamber to recover set point humidity as fast as possible. This leads to the problem outlined above.

KEEPING CONTAMINANTS OUT: This goes hand-in-hand with recovery time. When a user opens a door, moisture and particulate contaminants should be kept out.

UNIFORMITY: Current methods do not produce uniform humidity concentrations throughout the chambers, especially in single-channel control modules.

INTERRUPTION IN PURGE OPERATION: Stratification of gas or a plume of dry nitrogen gas can move over the humidity sensor, causing the sensor to measure low humidity concentrations and shut off the gas purge process prematurely. Consequently, this premature gas shut-off can compromise sensitive content within the desiccator.

ECONOMY OF USE: Current methods induce high levels of nitrogen gas consumption and waste to dilute moisture. This induces high consumption and waste of purge gas, driving up overhead cost. Wasteful purging can drive up overhead costs for manufactures with a higher frequency of nitrogen generator or nitrogen canister replacement. This is a common concern for users, particularly those who rely on gas canisters that must be frequently replaced.

Prior Art Solutions to Problems:

HIGHER PURGE RATE: The current solution to mitigate the problems stated above is to increase the gas flow rate and attempt to purge by brute force, but this solution increases gas consumption and operating expense.

PURGE BY DISPLACEMENT: Currently, the rationale behind the prior art design is to attempt to purge moisture by displacement. This means that nitrogen is released into the container without intermixing with the induced air and displacing it out of a release valve. In accord with the displacement model, designers install as many bleed valves as possible, as elaborated below.

PERFORATED PLENUMS: Perforated plenums attempt to improve uniformity and efficiency of displacing the air in the container with laminar air flow.

AUTOMATIC PURGE CONTROL UNITS: Purge control units switch to high purge when ambient is above set point and switch to a slow bleed purge after to maintain positive pressure. Additionally, some desiccators are configured with door sensors to actuate a high purge when a door is opened. This keeps contaminants out.

MULTIPLE BLEED/RELEASE VALVES: Multiple exhaust valves optimize purging efficiency and uniformity. The uniformity of the purge is proportional to the number of exhaust valves.

INDIVIDUALLY CONTROLLED CHAMBERS: The current most effective way to address economical consumption with a quick recovery time is to have a dedicated control unit and gas line for each individual chamber versus having one for all chambers in the cabinet. This can cost approximately $1,200.00 for each chamber and is typically too expensive for the market. Because of its price, there has been little commercial success compared to other configurations.

SUMMARY

I have discovered that purging by displacement, such as illustrated in Figures A and B, is not the most effective way to introduce a purge gas into a desiccator and mix this purge gas with moist air in the desiccator's chambers. In accordance with my method, a desiccating purge gas is introduced into the desiccator's chambers in a manner that circulates the gas within the chambers as gas is slowly bled from the chambers, continually diluting the gas within the chambers with a fresh supply of desiccating gas. In order to improve efficiency, the gas in the desiccator's chambers is constantly circulated and mixed with a fresh supply of desiccating gas, continuously diluting the gas within the desiccator with fresh desiccating gas. Care is taken to constantly circulate the gases within the chambers, maximizing turbulent flow within the chambers. This eliminates dead-zones within the chambers where air would otherwise be stagnant. My method achieves a uniform relative humidity throughout all my desiccator's chambers more rapidly than the prior art desiccators discussed above and with a minimum usage of purge gas. The graphs in FIGS. 29 through 33 and the Table in FIG. 34 illustrate this feature of my desiccator and method.

Optimization of my purge and mixing method may be facilitated by using a mechanically-assisted plenum mixing chamber to uniformly and rapidly reduce moisture concentration, leading to greater relativity humidity uniformity while minimizing purge gas consumption. My desiccator includes means for circulating the gas from the desiccator's chambers through the plenum mixing chamber. Such circulating means includes fans, a fan housing, and a fan speed controller. Mechanically-assisted mixing in the plenum mixing chamber ensures uniformity of purge gas dispersion throughout the desiccator.

My desiccator includes a purge controller, one or more one-way bleed valves, and a humidity set-point controller. The purge controller regulates the flow rate of the desiccating gas through an inlet and into the chambers, activating a high flow when a chamber door is open to inhibit moisture or contaminants from entering the chamber. The purge controller operates to provide a low positive pressure within the chambers when the doors of the chambers are closed and a high flow rate that inhibits moisture or contaminants from entering the chambers upon opening a door of a chamber or upon detection of the relative humidity exceeding the set point. The one-way bleed valve or valves allow gas within the chambers to constantly flow out from the desiccator while maintaining a positive pressure within the desiccator. Generally, the positive pressure is 0.05 inches of water column.

The humidity set-point controller establishes the desired relative humidity within the interior of the desiccator. A humidity sensor or sensors within my desiccator's interior measures the relative humidity and provides a signal to the set-point controller. A manually selected set point value is set so that, whenever the relative humidity within the interior of my desiccator exceeds this value, the humidity sensor signals the purge controller, which responds to introduce into the interior of my desiccator a desiccating purge gas. The purge gas is fed into the desiccator's chambers and concurrently the purge controller constantly operates the circulating means, such as a fan. The dew point of the desiccating gas is from −20 to −90 F°, the pressure of the desiccating gas is from 30 to 120 psi, and the average flow rate of the desiccating gas into a 1-12 cubic foot desiccator is from 0.25 to 4.0 cubic feet per minute.

The circulating means may be operated from low to high speeds with a variable speed controller, depending on the user's preference. For desiccators having a capacity from 2.5 to 30 cubic feet: the airflow can be adjusted to range anywhere between 0 and 250 cubic feet per minute (cfm). High gas flow circulation improves the ability of the purge gas to accelerate dilution in hard-to-reach dead end cavities and facilitates mixing. When a chamber door is opened, a door sensor signals the purge controller to shut off the circulating means. This prevents outside air from being drawn into the desiccator cabinet. Simultaneously, the controller activates means for introducing into the chambers the purge gas at high pressure. This further hastens the dilution of any moist air, because more purge gas enters the chambers than moist air. Once all chamber doors are closed, the circulating means is immediately reactivated to facilitate the mixing and dilution process. The moisture that enters the chambers upon opening a door is rapidly dispersed throughout the entire interior volume of the desiccator within seconds and the set-point humidity is recovered quickly, usually within minutes. The high-pressure purge gas is continually introduced into the chambers until the selected relative humidity set-point is reached.

My desiccator and method have one or more of the features depicted in the embodiments discussed in the section entitled "DETAILED DESCRIPTION OF SOME ILLUSTRATIVE EMBODIMENTS." The claims that follow define my desiccator and method, distinguishing them from the prior art; however, without limiting the scope of my desiccator and method as expressed by these claims, in general terms, some, but not necessarily all, of their features are:

One, my desiccator comprises a plurality of chambers in series communication with each other so a desiccating gas flows from one chamber into an adjacent chamber.

Two, the chambers may be vertically stacked together and comprise, for example, a top storage chamber, a bottom storage chamber, and at least one intermediate storage chamber. The intermediate storage chamber may have opposed spaced apart perforated horizontal sides that allow gas to flow upward from the bottom storage chamber through the intermediate storage chamber into the top storage chamber.

Three, an elongated plenum chamber may extend vertically lengthwise along a side of the desiccator opposite a side along which the doors are positioned. This plenum chamber is in communication with the inlet and has one end in communication with the top storage chamber and another end in communication with the bottom storage chamber.

Four, in my desiccator, an inlet in allows a desiccating purge gas to be introduced into the desiccator's chambers at a predetermined flow rate, and a one-way bleed valve that allows gas within the chambers to constantly flow from the desiccator while maintaining a positive pressure within the desiccator. This positive pressure is approximately 0.05 inches of water column when purging, vary based on the configuration of the cabinets and the number of bleed/release valves installed.

Five, in my desiccator, a fan constantly mixes and circulates the gas between the chambers as the desiccating purge gas is introduced into the desiccator, constantly diluting the gas within the chambers with a fresh supply of the desiccating gas. The fan may be in the plenum chamber and may include a variable speed control mechanism that enables a user to change the speed of the fan.

Six, my desiccator may include one or more door sensors that detect when a door of a chamber is open and closed. The door sensors provide a signal to a controller to shut off the fan to discontinue mixing and circulating the gas upon detecting a door being opened. The controller may also regulate the flow rate of the desiccating gas through the inlet and into the chambers. This controller introduces enough desiccating gas into the chambers so that the chambers are at a predetermined humidity.

Seven, in my desiccator, the chambers have doors that are manually opened and closed, and the controller may be operated to provide purge gas at different rates. For example, at a low flow rate when the ambient humidity is equal to or less than the set point humidity within the desiccator while the doors of the chambers are closed, and a high flow rate when the ambient humidity is above the humidity set point or upon opening a door of a chamber.

These features are not listed in any rank order nor is this list intended to be exhaustive.

My method of storing items uses a desiccator having a plurality of chambers in communication with each other, and comprises introducing a dry, pressurized desiccating gas into the desiccator's chambers in a manner that constantly circulates the gas between the chambers as gas is slowly bled from the chambers, constantly diluting the gas within the chambers with a fresh supply of the desiccating gas. The desiccating gas has a dew point from −20 to −90 F°, the pressure of the desiccating gas being from 30 to 120 psi, and the average flow rate of the desiccating gas into the desiccator being from 0.25 to 4.0 cubic feet per minute.

DESCRIPTION OF THE DRAWING

Some embodiments of my desiccator and method are discussed in detail in connection with the accompanying drawing, which is for illustrative purposes only. This drawing includes the following figures (Figs.), with like numerals and letters indicating like parts:

FIG. 22 is a plan view of the left side panel of my desiccator, showing its interior surface.

FIG. 22A is an enlarged fragmentary view taken along the line 22A of FIG. 22.

FIG. 23 is a perspective view of a left side panel of my desiccator, showing its interior surface.

FIG. 34 is a table showing efficiency comparisons of air circulation speeds.

FIG. 38 is a perspective view of individual component parts used in my desiccator.

DETAILED DESCRIPTION OF SOME ILLUSTRATIVE EMBODIMENTS

General

Figure 1A:
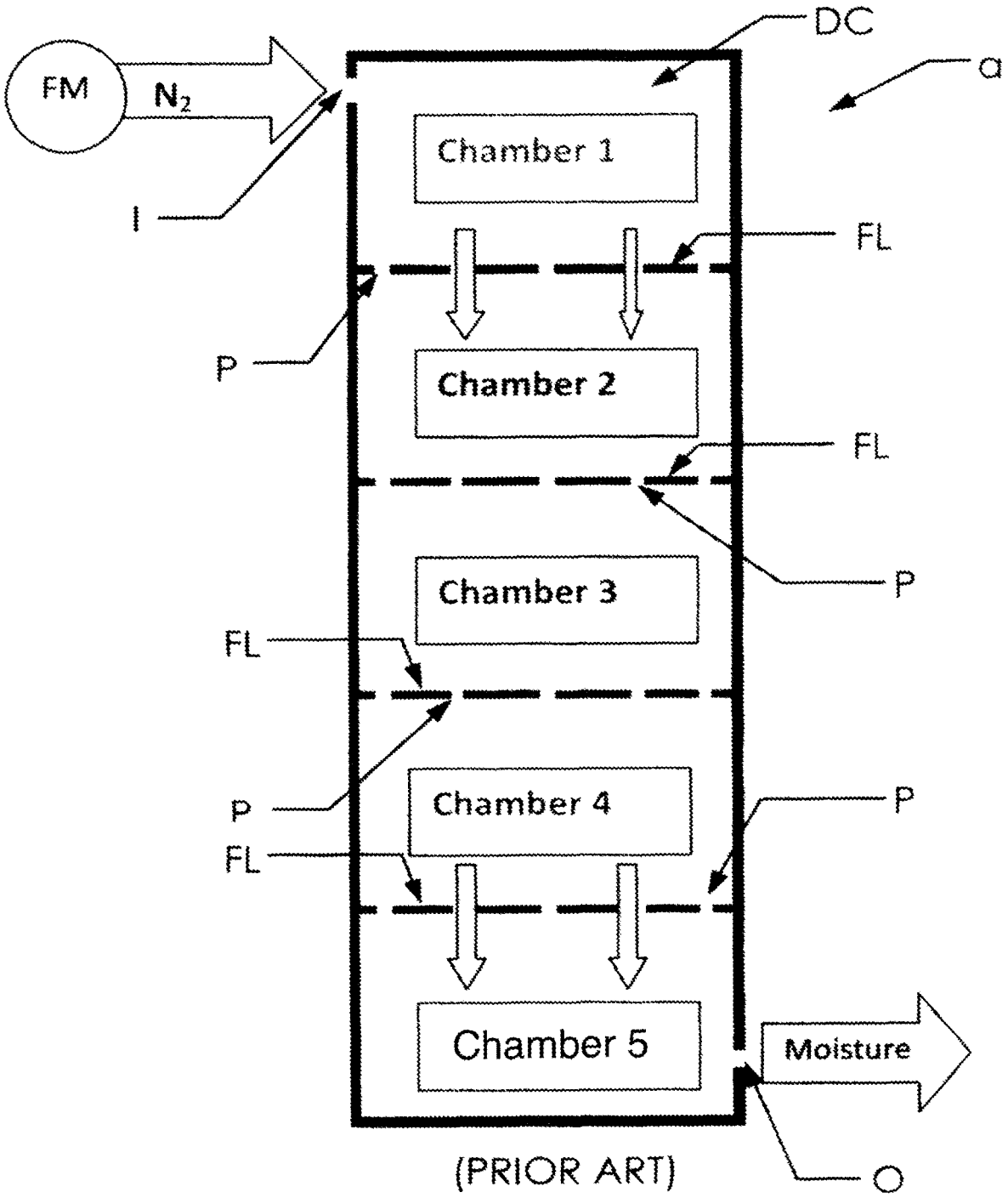
FIG. 1A is a schematic illustration of one version of a prior art desiccator.
Figure 1B:
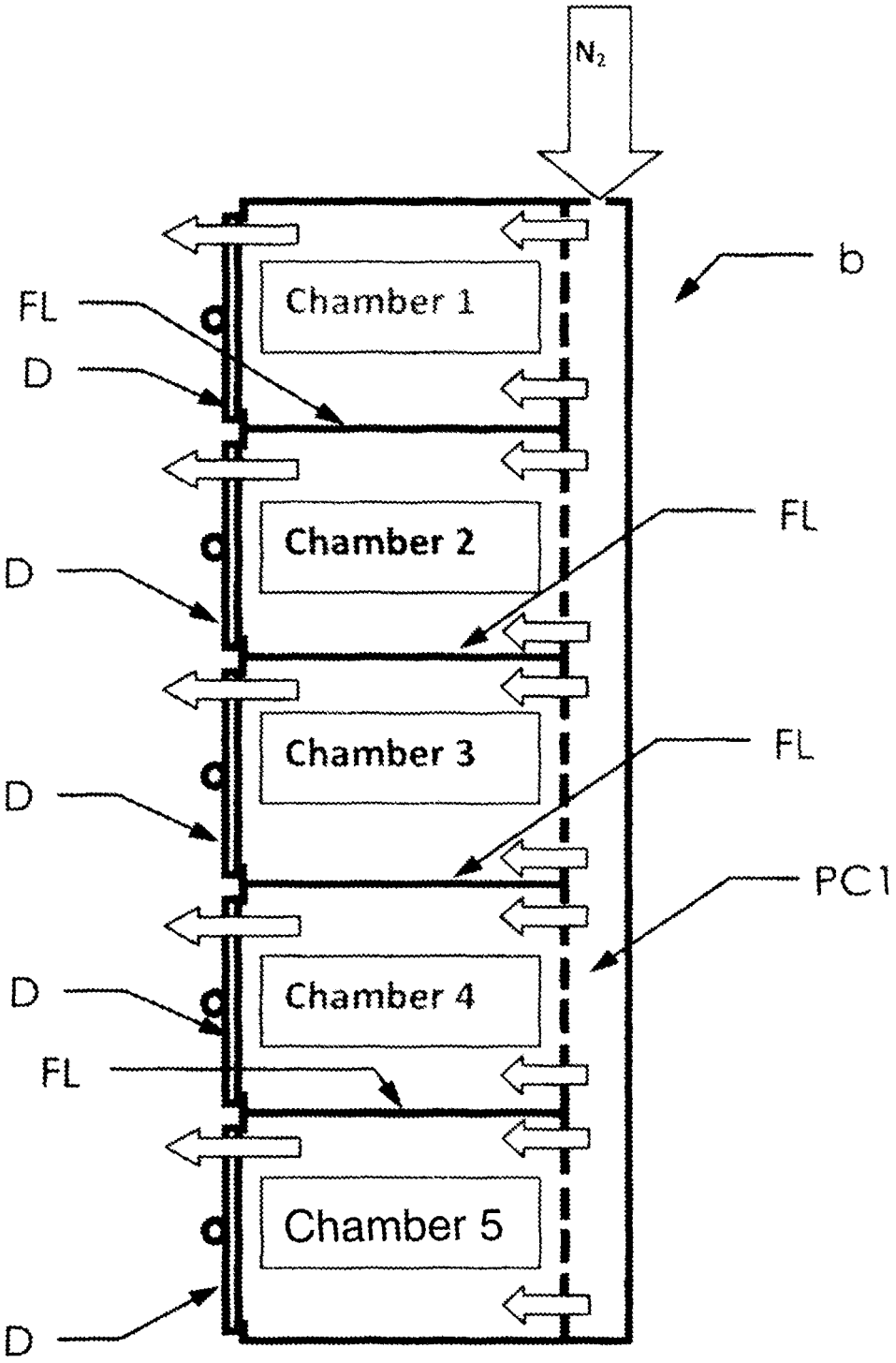
FIG. 1B is a schematic illustration of a second version of a prior art desiccator.
Figure 1C:
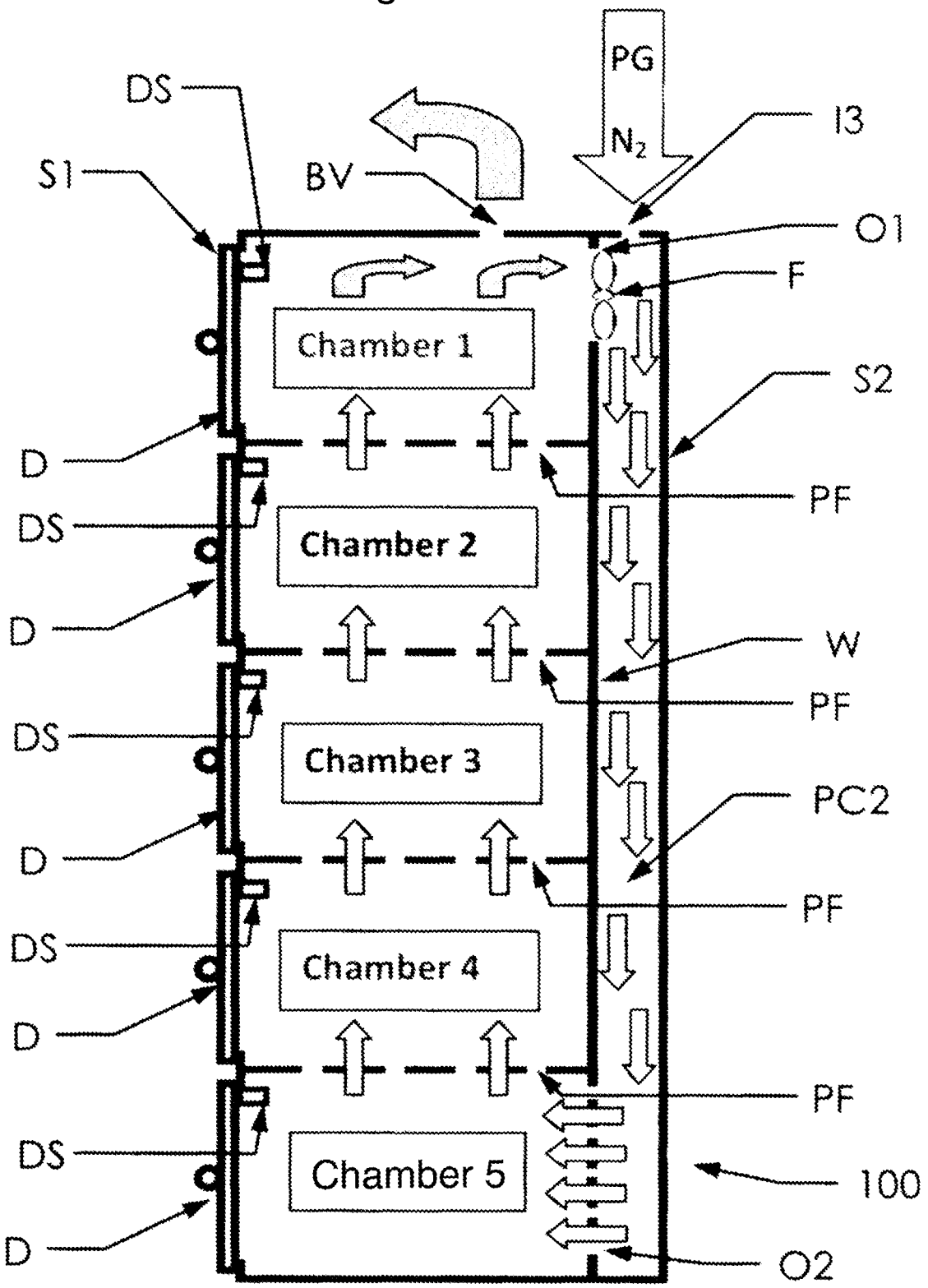
FIG. 1C is a schematic illustration of my desiccator.

Figure C illustrates one embodiment of my desiccator 100 comprising a plurality of chambers 1-5 in series communication with each other so gas flows from one chamber into an adjacent chamber. There is an inlet 13 near the top of the chamber 1 through which a desiccating purge gas PG is introduced into the desiccator 100 at a predetermined flow rate. A one-way bleed valve BV allows gas within the chambers to constantly flow from the desiccator 100 at a rate that is less than the predetermined flow rate of purge gas entering the desiccator 100. A fan F constantly mixes and circulates gas between the chambers 1-5 as fresh desiccating purge gas PG is introduced through the inlet 13 into the desiccator 100, constantly diluting the gas within the chambers with a fresh supply of the desiccating purge gas PG.

Each chamber 1-5 has a front door D along the same one side S1 of the desiccator 100. Associated with each front door D is a magnetic door sensor DS that detects when a door D is open and closed. These door sensors DS provide a signal to a purge gas controller 50 (FIG. 35 & FIG. 36) to shut off the fan F to discontinue mixing and circulating the gas upon detecting a door D being opened. A suitable purge gas controller 50 is sold by Terra Universal, Inc. of Fullerton, Calif., under the name DUALPURGE™. This purge gas controller 50 also regulates the flow rate of the desiccating gas through the inlet 13 and into the chambers 1-5, introduces enough desiccating gas into the chambers so the chambers are at a predetermined humidity set point, and optionally may provide a low positive pressure within the chambers when the doors D of the chambers are closed and a high positive pressure that inhibits moisture or contaminants from entering the chambers upon opening a door D of a chamber. The fan F is stopped whenever a door D is opened to avoid drawing moist air and contaminants into the desiccator 100.

An elongated plenum chamber PC2 extends vertically lengthwise along a side S2 of the desiccator 100 opposite the side S1 along which the doors D are positioned. The plenum chamber PC2 is in communication with the inlet 13 and has one end in communication with the top storage chamber 1 and another end in communication with the bottom storage chamber 5. A solid wall W of the plenum chamber PC2 forms the rear wall of the chambers 2, 3, and 4, preventing gas in the plenum chamber PC2 from directly entering these chambers from the plenum chamber PC2. The fan F is located in the upper portion of the plenum chamber PC2 and pulls gas from chambers 1-5 through a rear opening O1 in the chamber 1 into the upper end of the plenum chamber PC2 that is in direct communication with the inlet 13 at the top of the plenum chamber PC2. The fan F pushes gas downward along the plenum chamber PC2 and through a rear opening O2 in chamber 5 into this chamber. The chambers 1-4 have perforated floors PF that enable the gas in my desiccator 100 to be pushed upward by the fan F through these perforated floors PF, continually circulating the gas in series through the chambers 1-5 and the plenum chamber PC2.

FIGS. 1 through 25 and FIG. 35

Figure 1:
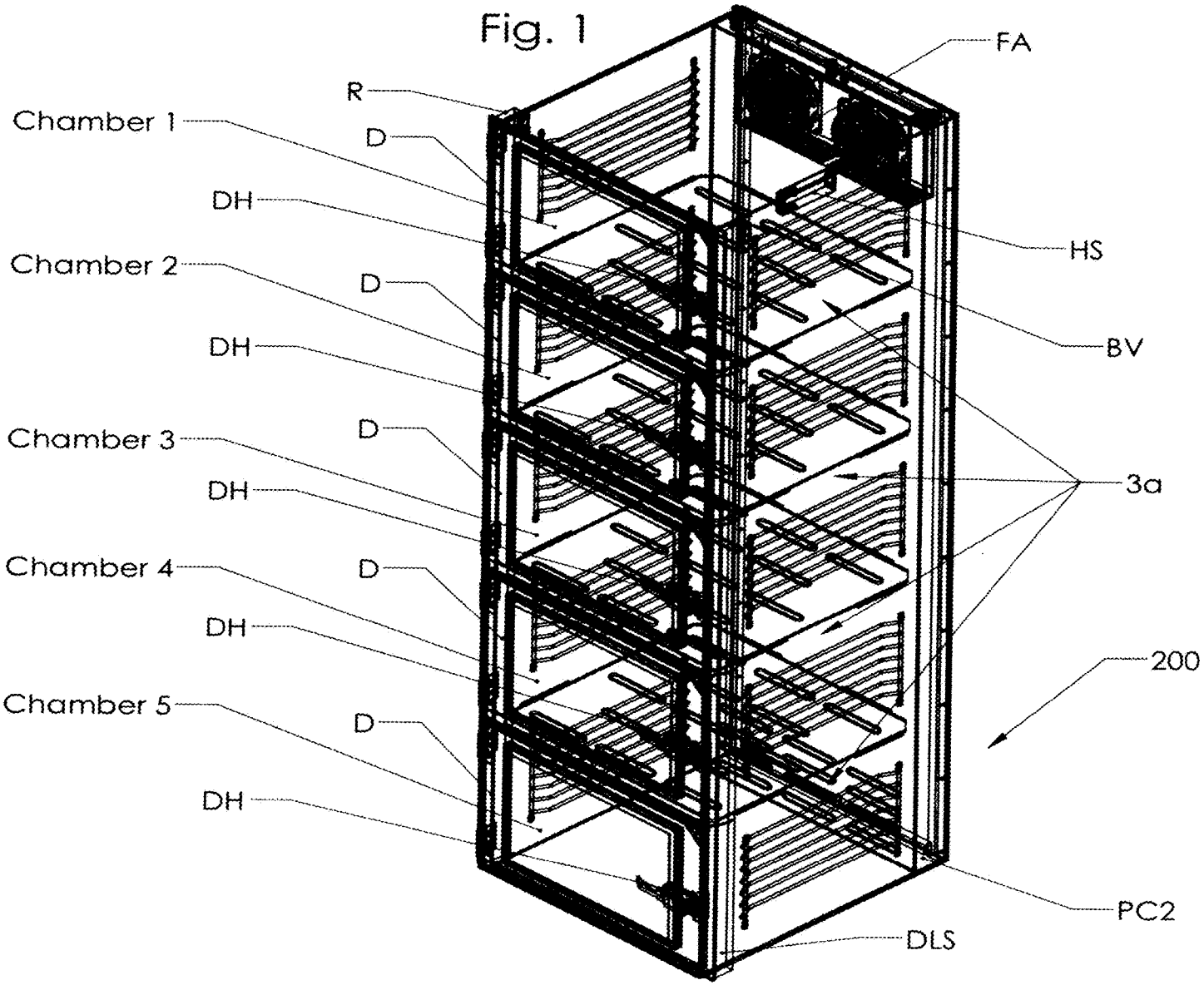
FIG. 1 is a perspective view of one embodiment of my desiccator with top and side panels removed to show the interior of the desiccator.
Figure 2:
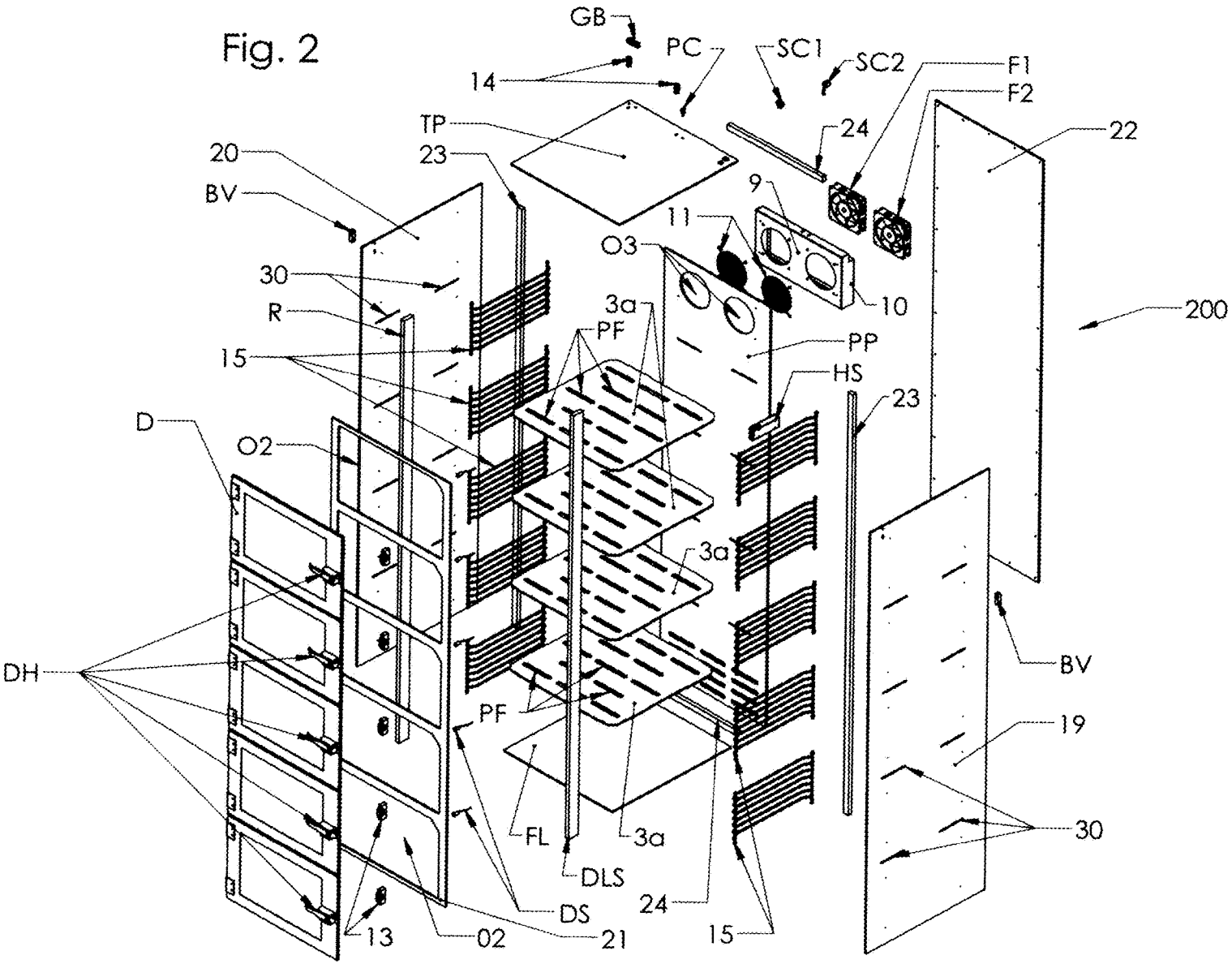
FIG. 2 is an exploded perspective view of the embodiment of my desiccator shown in FIG. 1.
Figure 5:
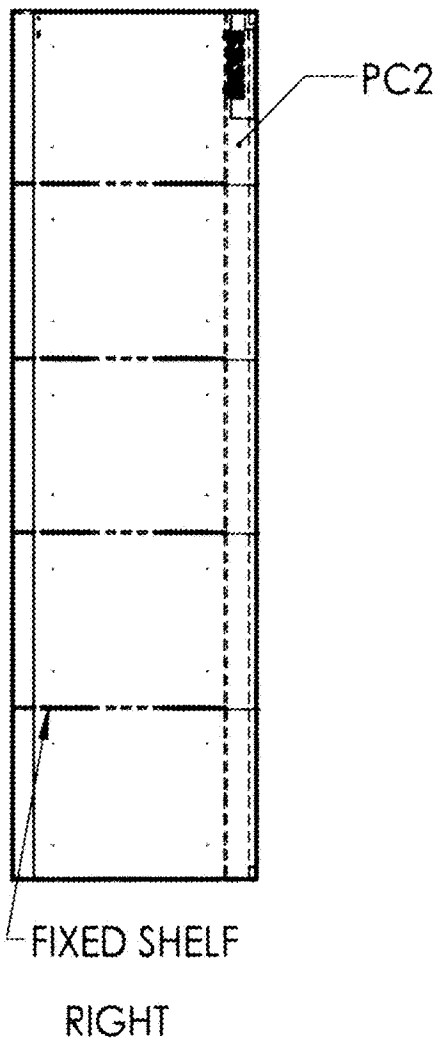
FIG. 5 is a right side view of the embodiment of my desiccator shown in FIG. 1.
Figure 4:
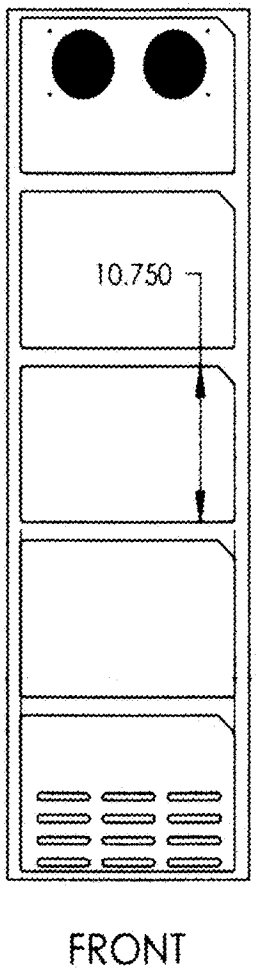
FIG. 4 is a front view, with chamber doors, removed of my desiccator shown in FIG. 1.
Figure 3:
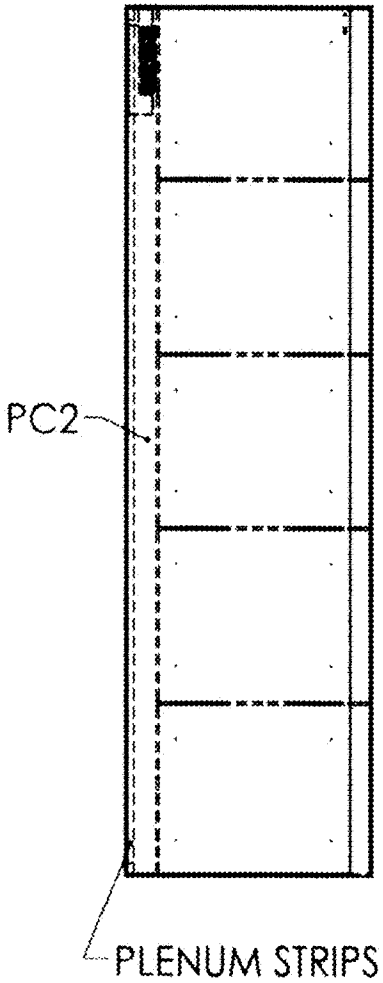
FIG. 3 is a left side view of the embodiment of my desiccator shown in FIG. 1.
Figure 6:
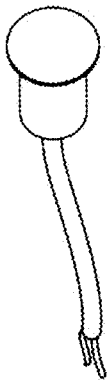
FIG. 6 is a perspective view of a magnetic door sensor.
Figure 8:
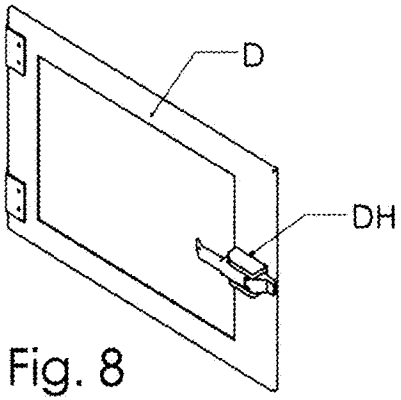
FIG. 8 is a perspective view of a door for the storage chambers of my desiccator shown in FIG. 1.
Figure 7:
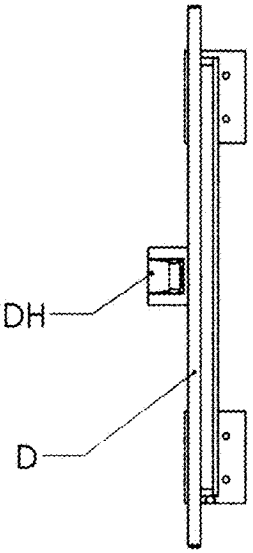
FIG. 7 is an end view of a door for the storage chambers of my desiccator shown in FIG. 1.
Figure 9:
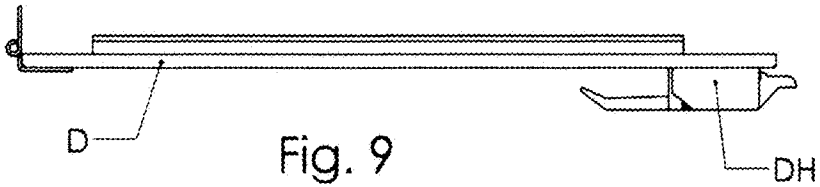
FIG. 9 is a top edge view of the door shown in FIG. 8.
Figure 10:
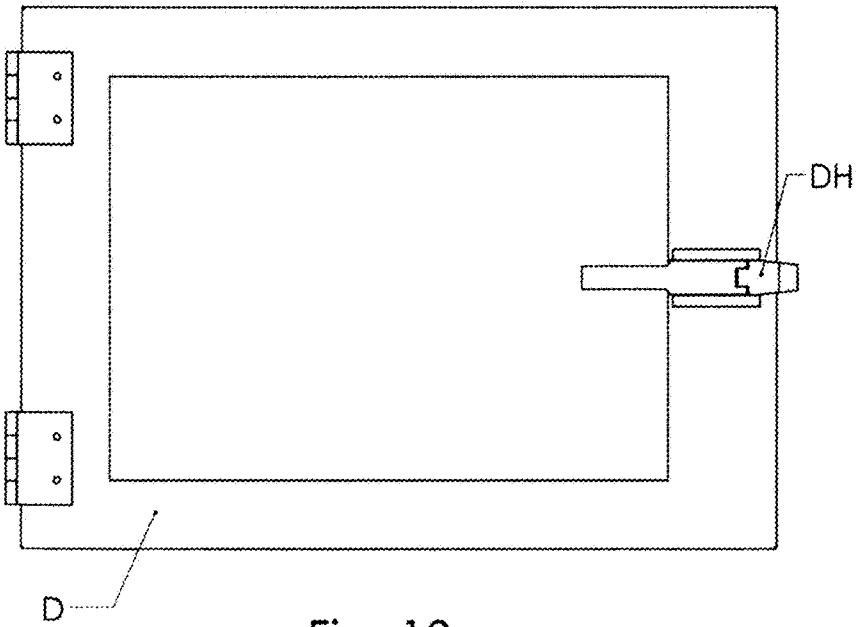
FIG. 10 is a front view of the door shown in FIG. 8.
Figure 12:
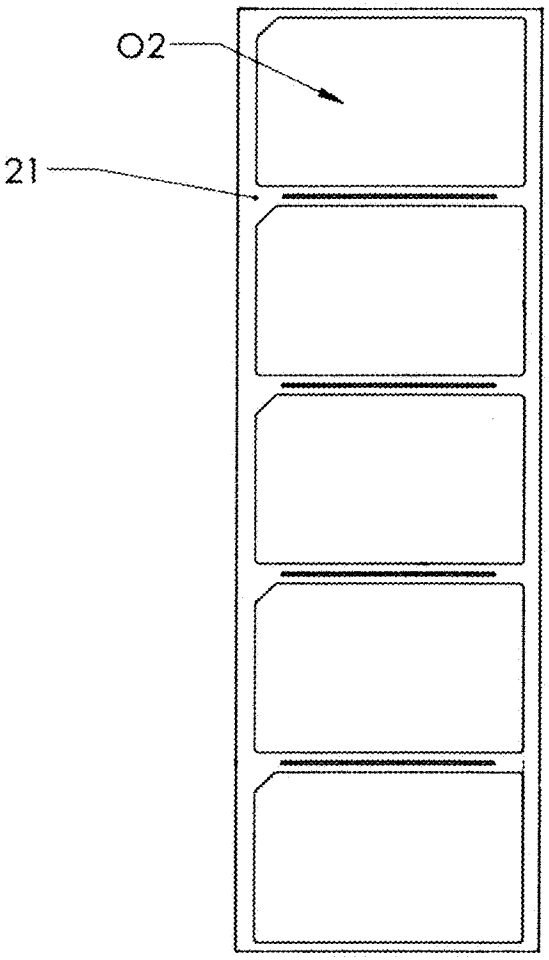
FIG. 12 is the front frame side depicted in FIG. 11 showing its interior surface.
Figure 11:
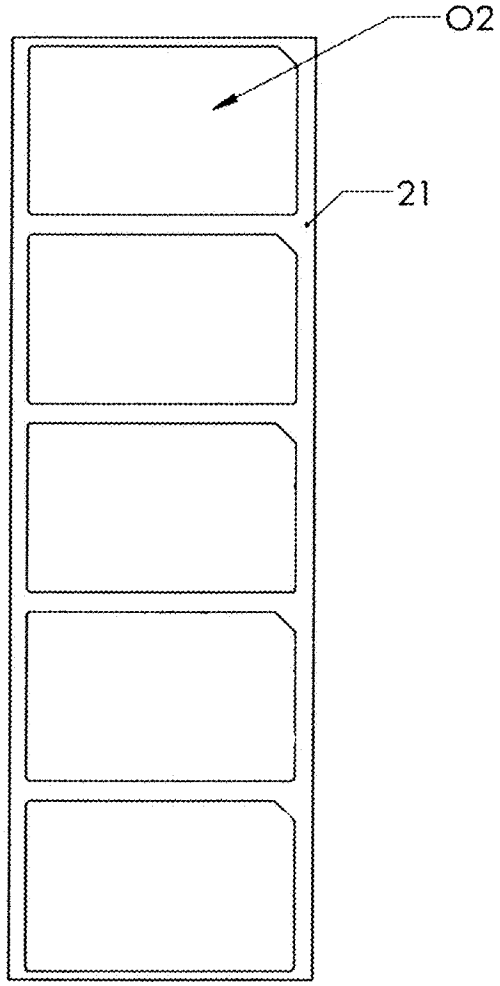
FIG. 11 is a front frame side of my desiccator depicted in FIG. 1 showing its exterior surface.
Figure 13:
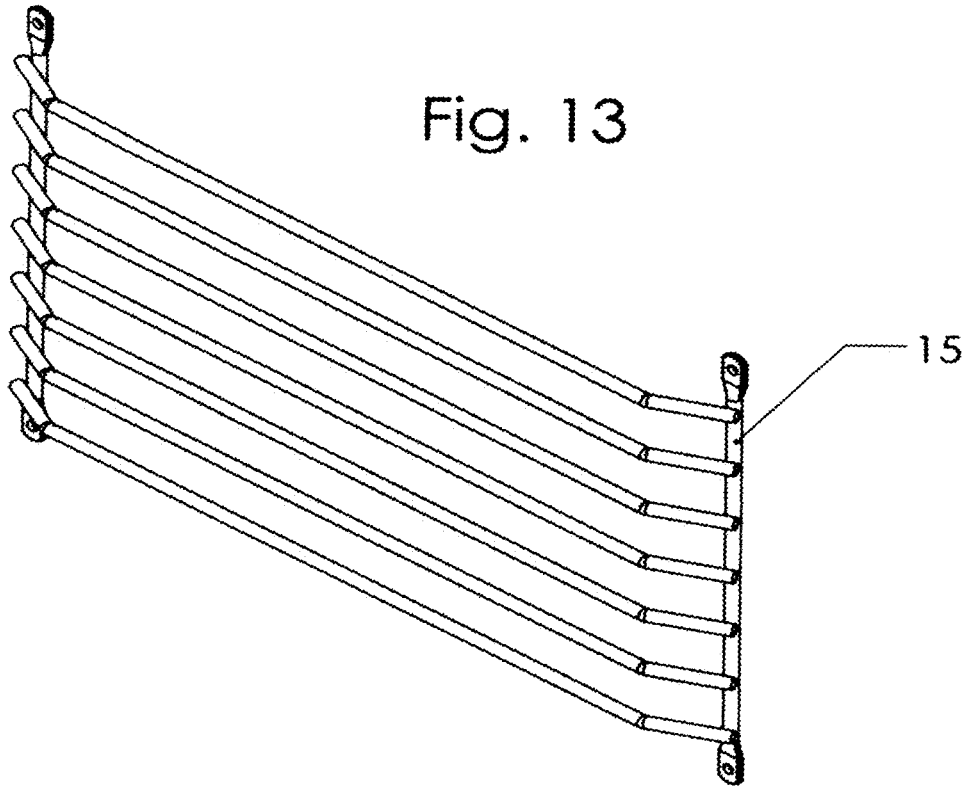
FIG. 13 is a perspective view of a storage rack used in my desiccator shown in FIG. 1.
Figure 14:
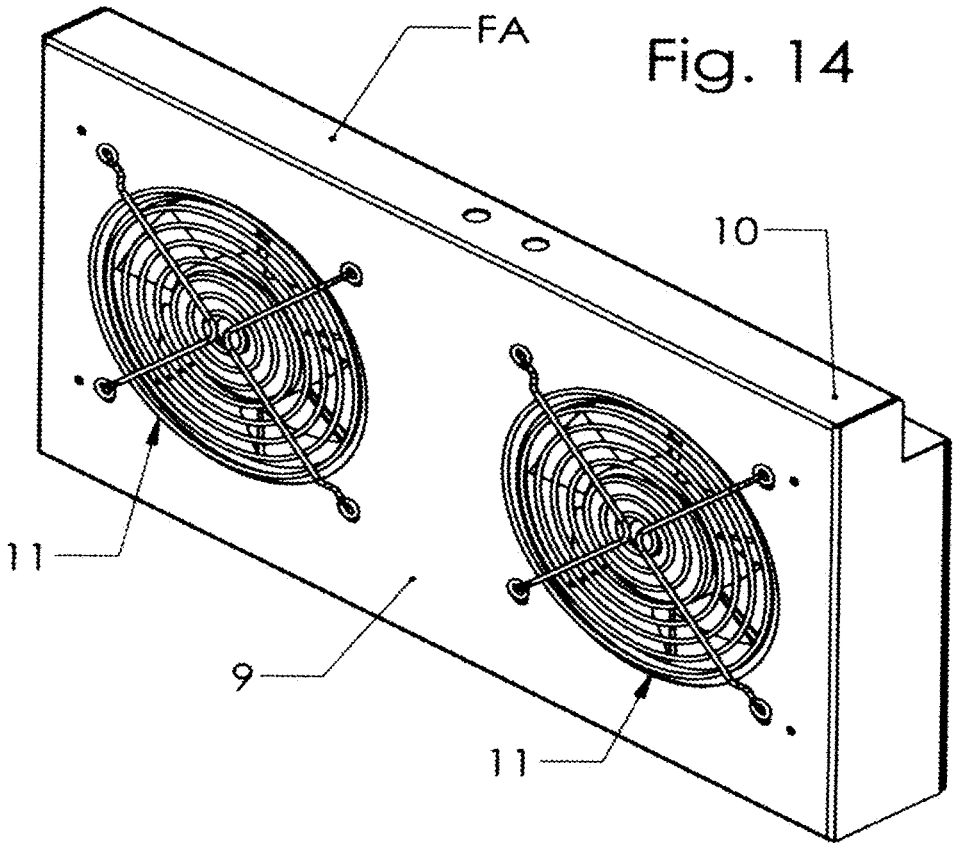
FIG. 14 is a perspective view of a fan assembly used in my desiccator shown in FIG. 1.
Figure 15:
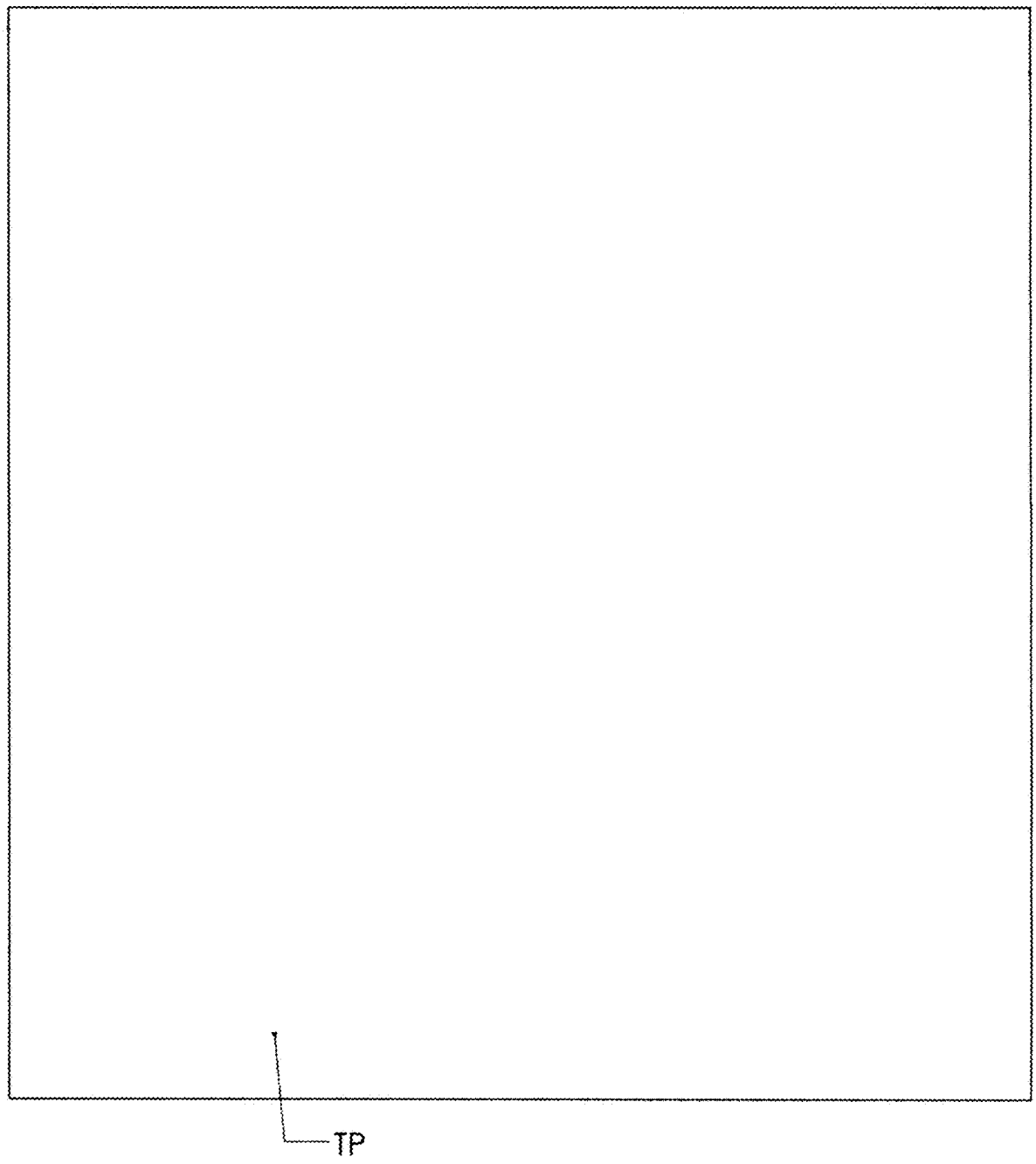
FIG. 15 is a plan view of the inside of the top panel of my desiccator.
Figure 16:
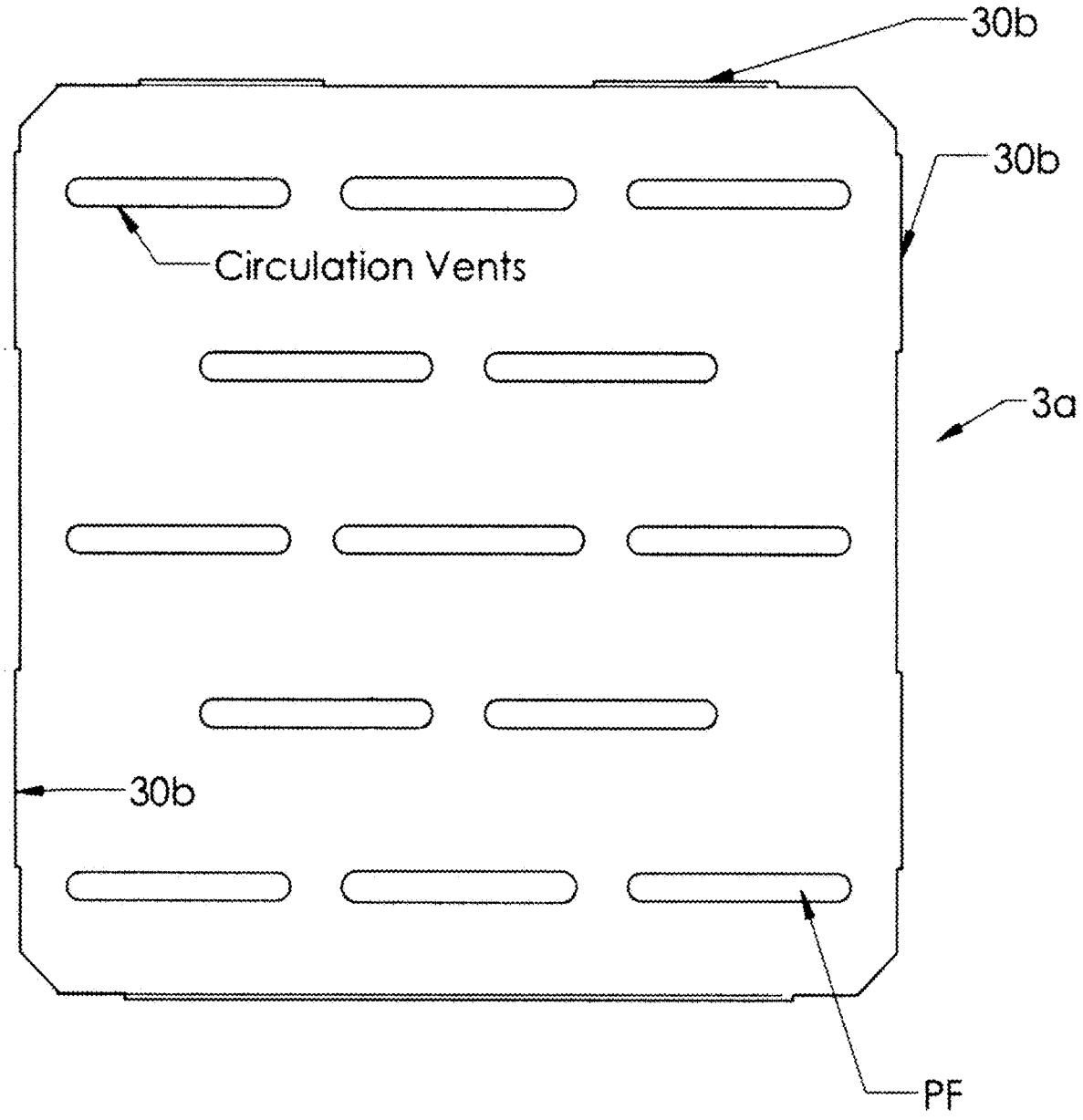
FIG. 16 is a cross-sectional view taken along line 16-16 of FIG. 4.
Figure 17:
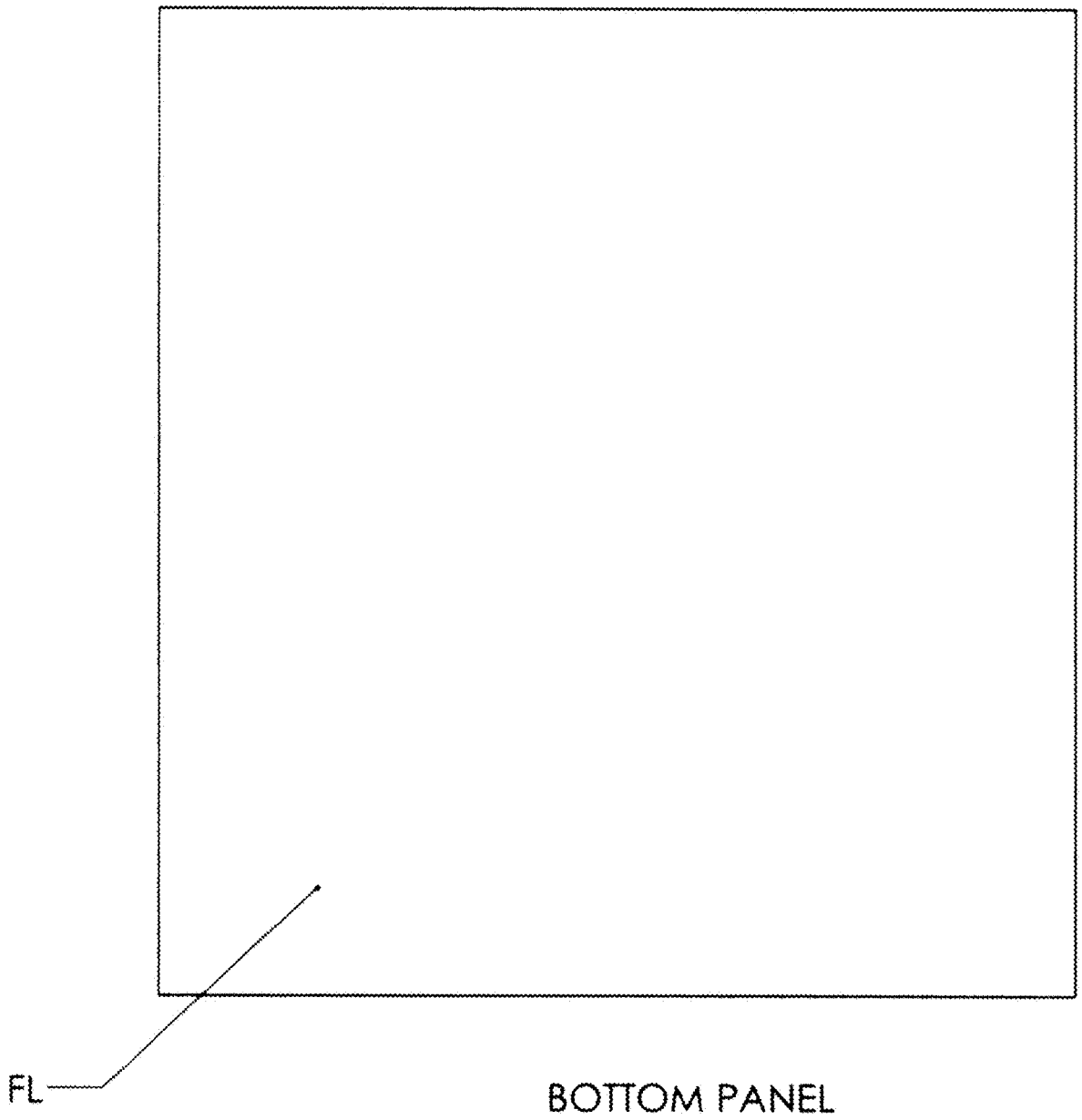
FIG. 17 is a plan view of the bottom panel of my desiccator.
Figure 20A:
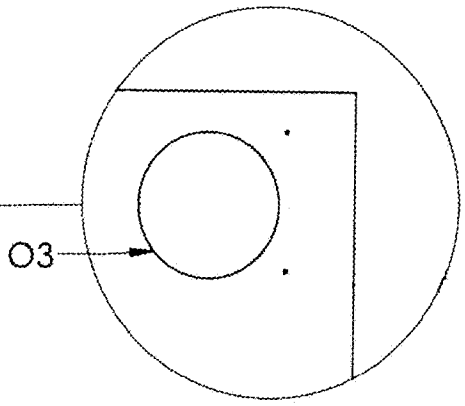
FIG. 20A is an enlarged fragmentary view taken along the line 20A of FIG. 20.
Figure 21:
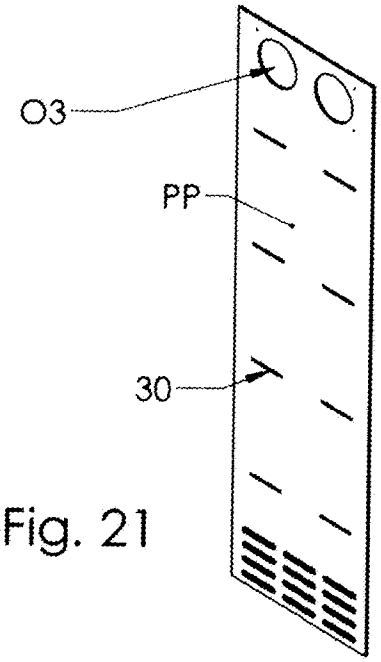
FIG. 21 is a perspective view of a rear panel of my desiccator, showing its interior surface.
Figure 20:
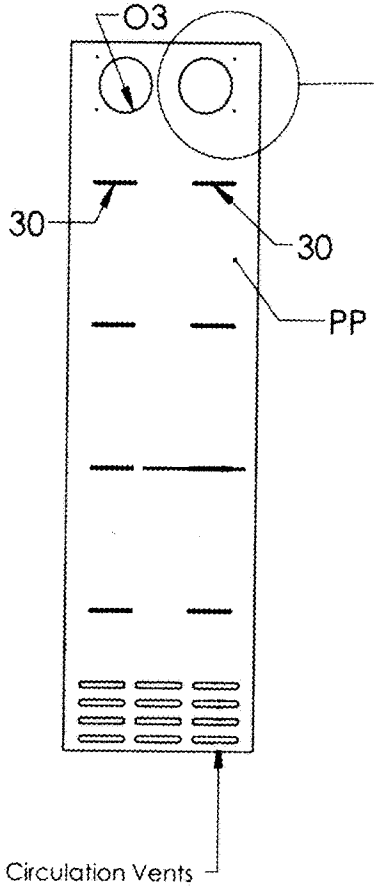
FIG. 20 is a plan view of the rear panel depicted in FIG. 18, showing its interior surface.
Figure 19:
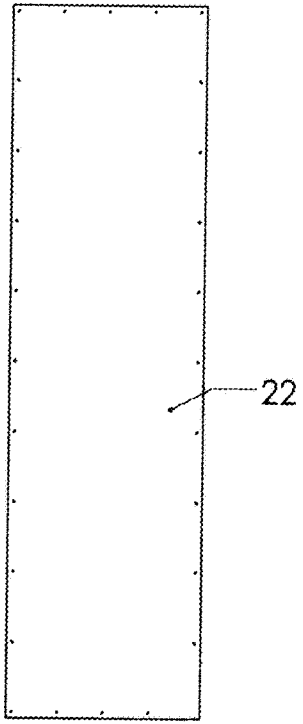
FIG. 19 is a plan view of the rear panel depicted in FIG. 18, showing its exterior surface.
Figure 18:
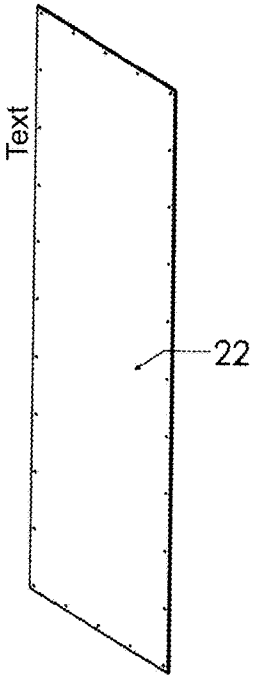
FIG. 18 is a perspective view of a rear panel of my desiccator, showing its exterior surface.
Figure 25:
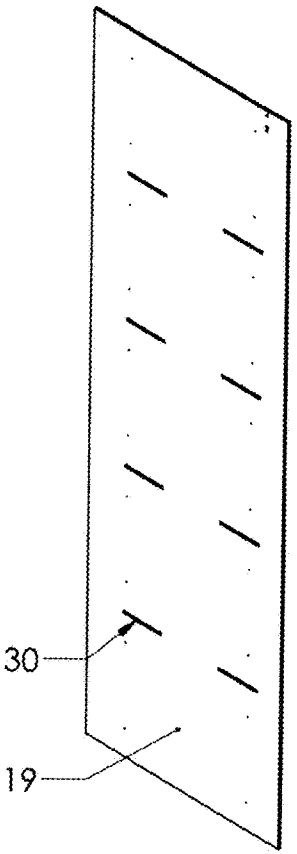
FIG. 25 is a perspective view of a right side panel of my desiccator, showing its interior surface.
Figure 24A:
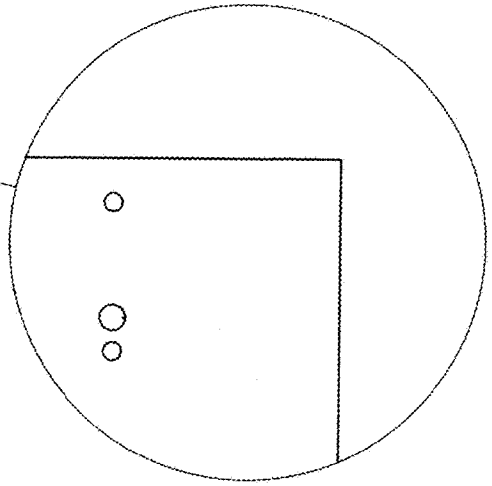
FIG. 24A is an enlarged fragmentary view taken along the line 24A of FIG. 22.
Figure 24:
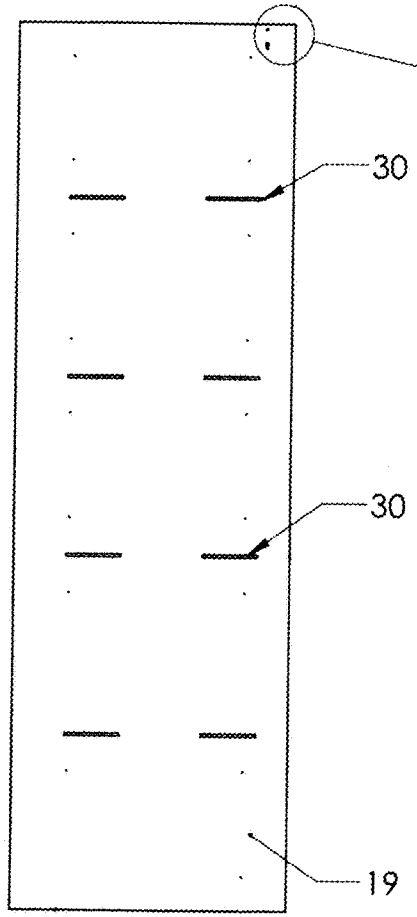
FIG. 24 is a plan view of the right side panel of my desiccator, showing its interior surface.
Figure 26:
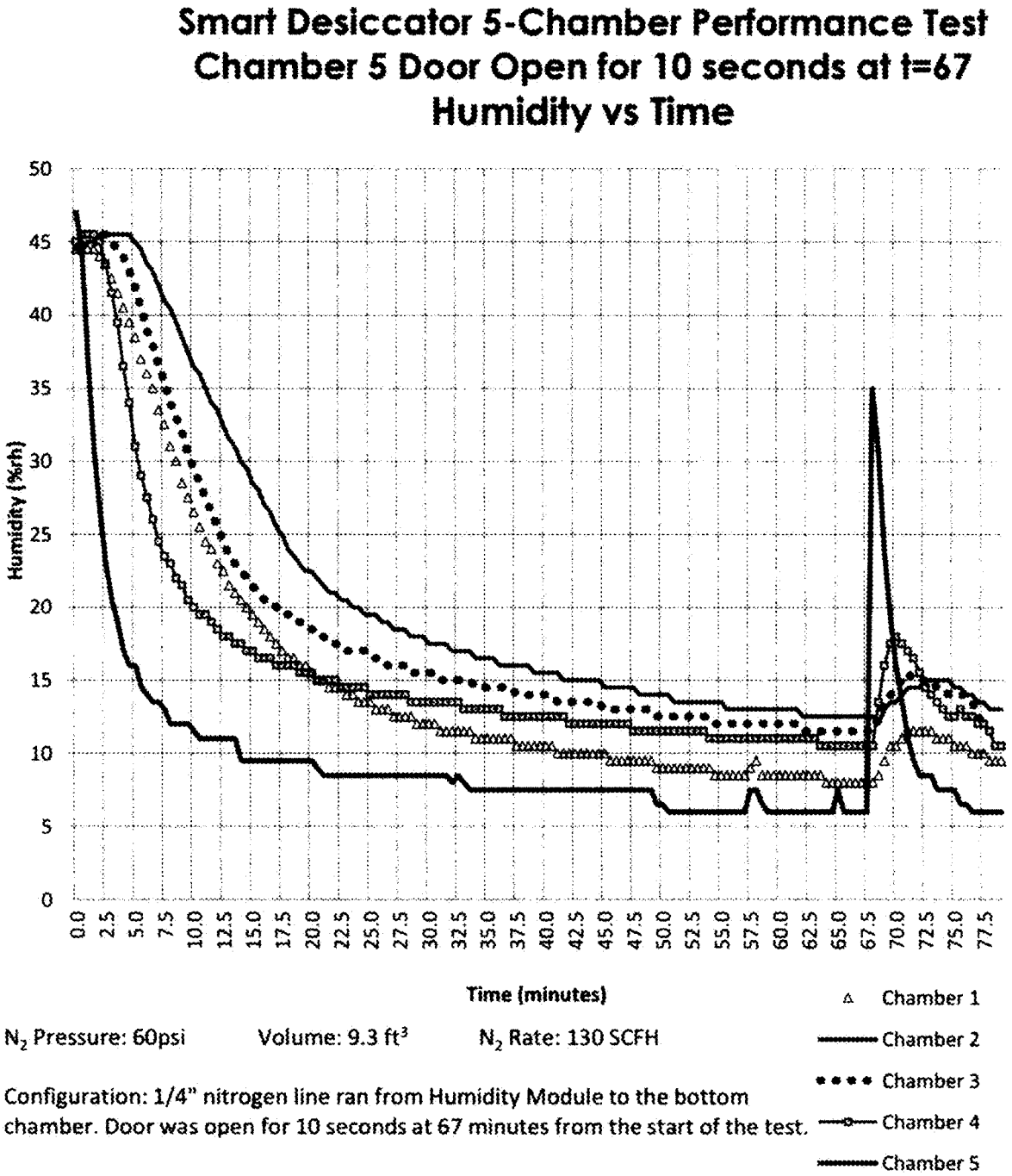
FIG. 26 is a graph showing results of performance test of prior art case I.
Figure 27:
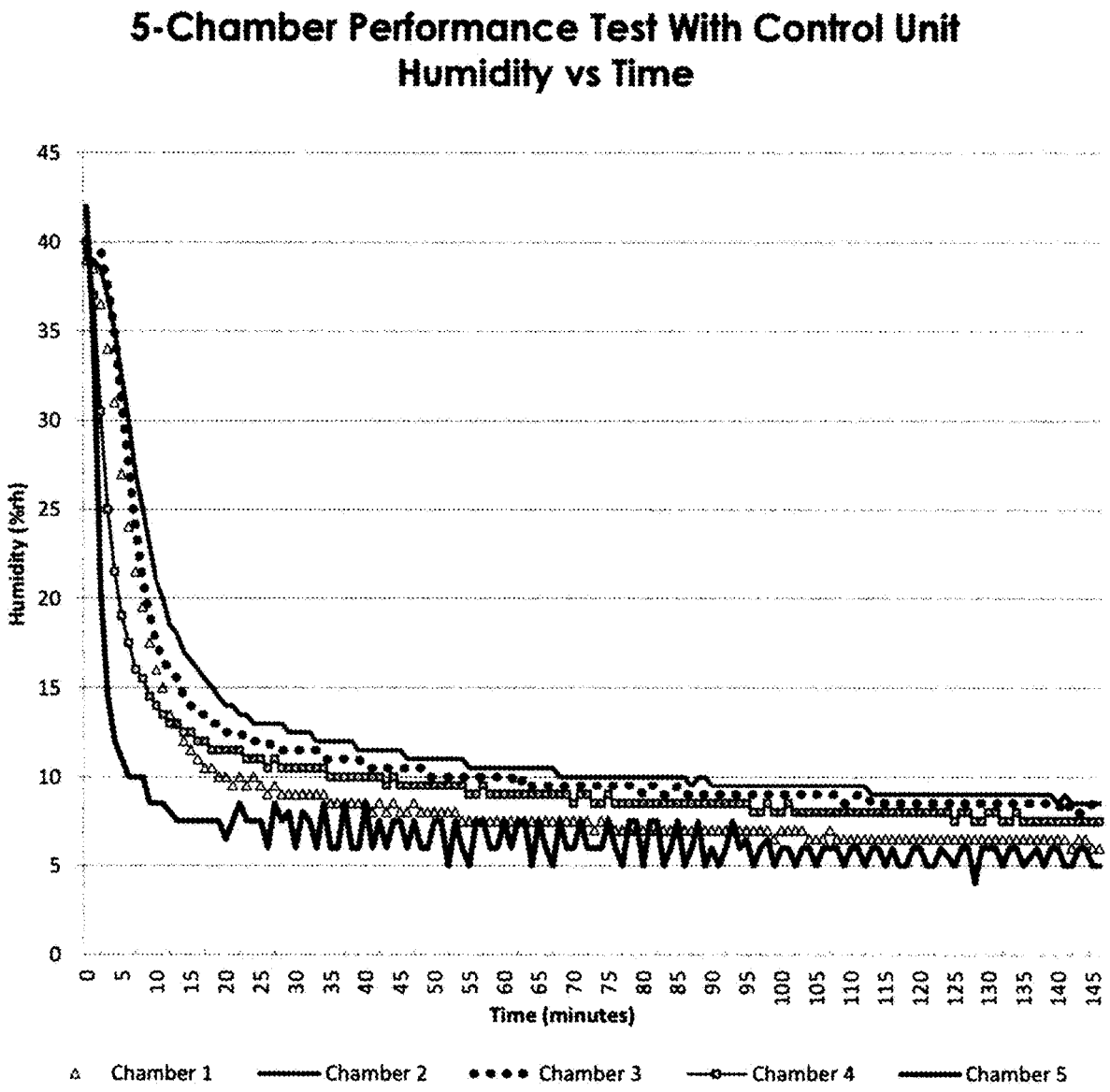
FIG. 27 is a graph showing results of performance test of prior art case II.
Figure 28:
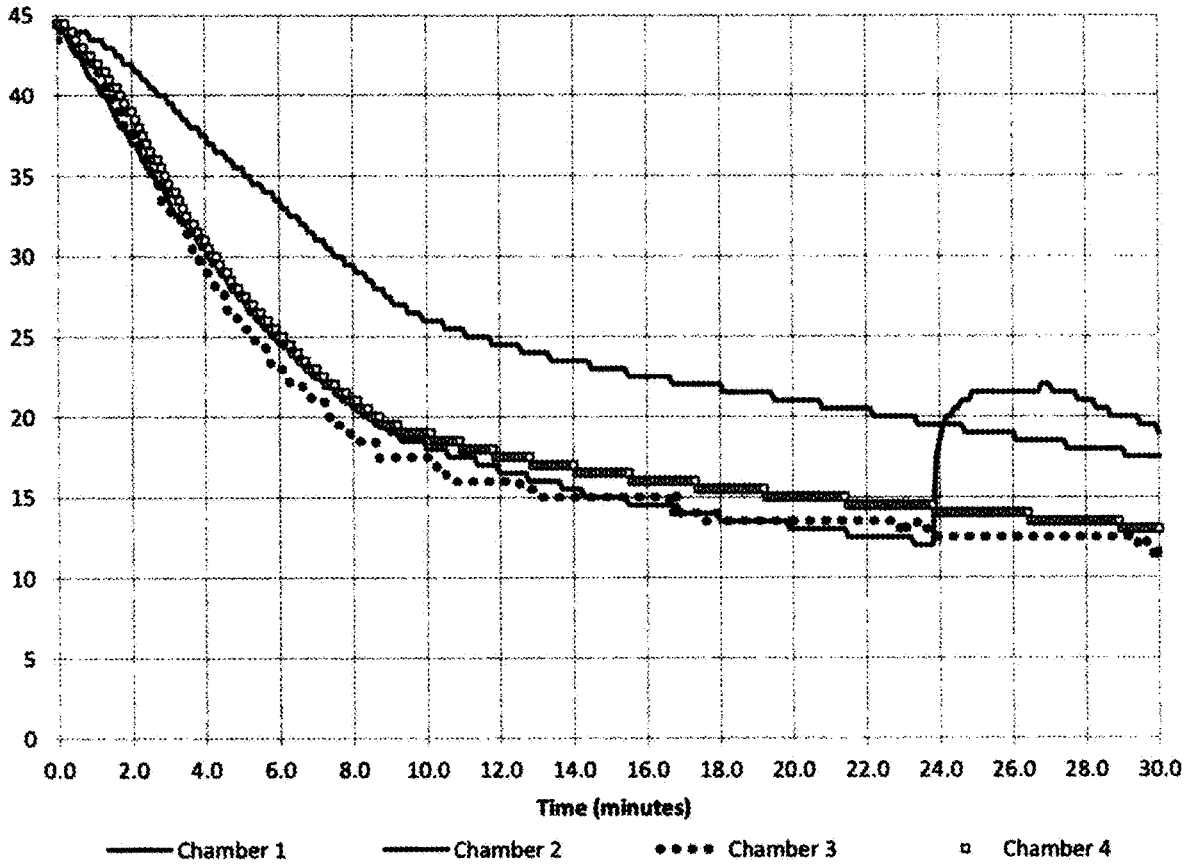
FIG. 28 is a graph showing results of performance test of prior art case III.
Figure 29:
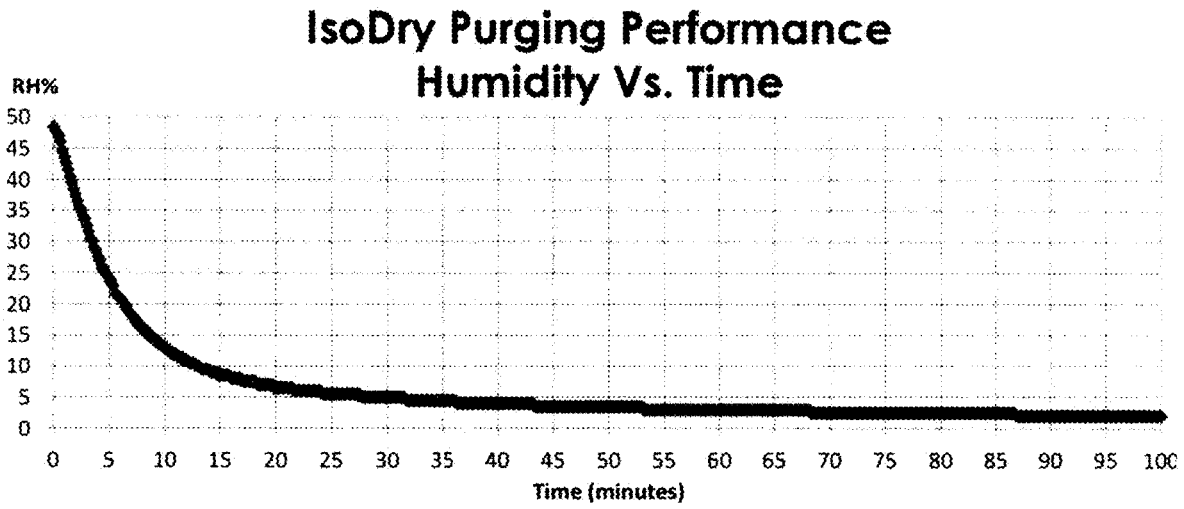
FIG. 29 is a graph showing results of performance test of my desiccator case I.
Figure 30:
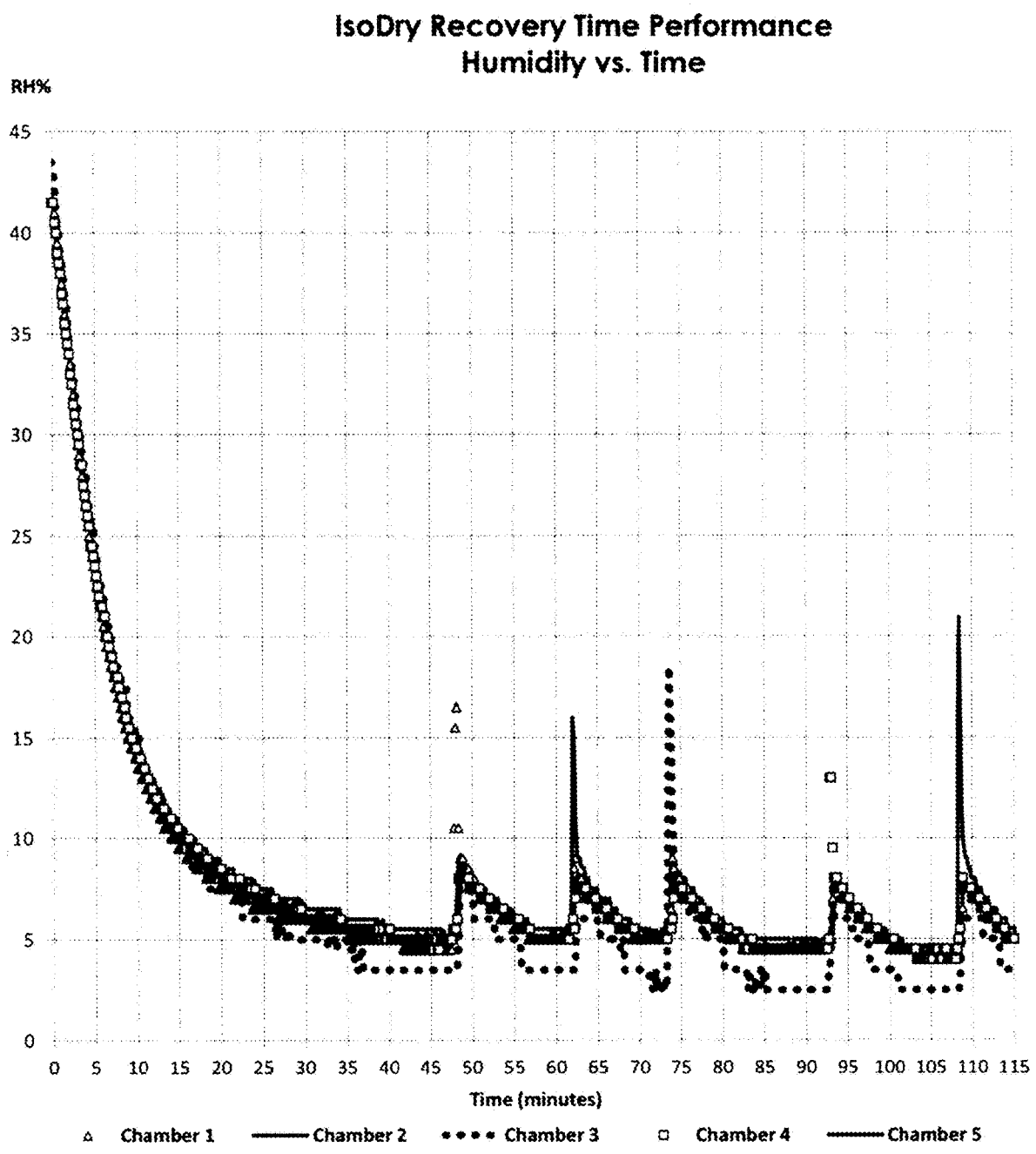
FIG. 30 is a graph showing results of performance test of my desiccator case I.
Figure 31:
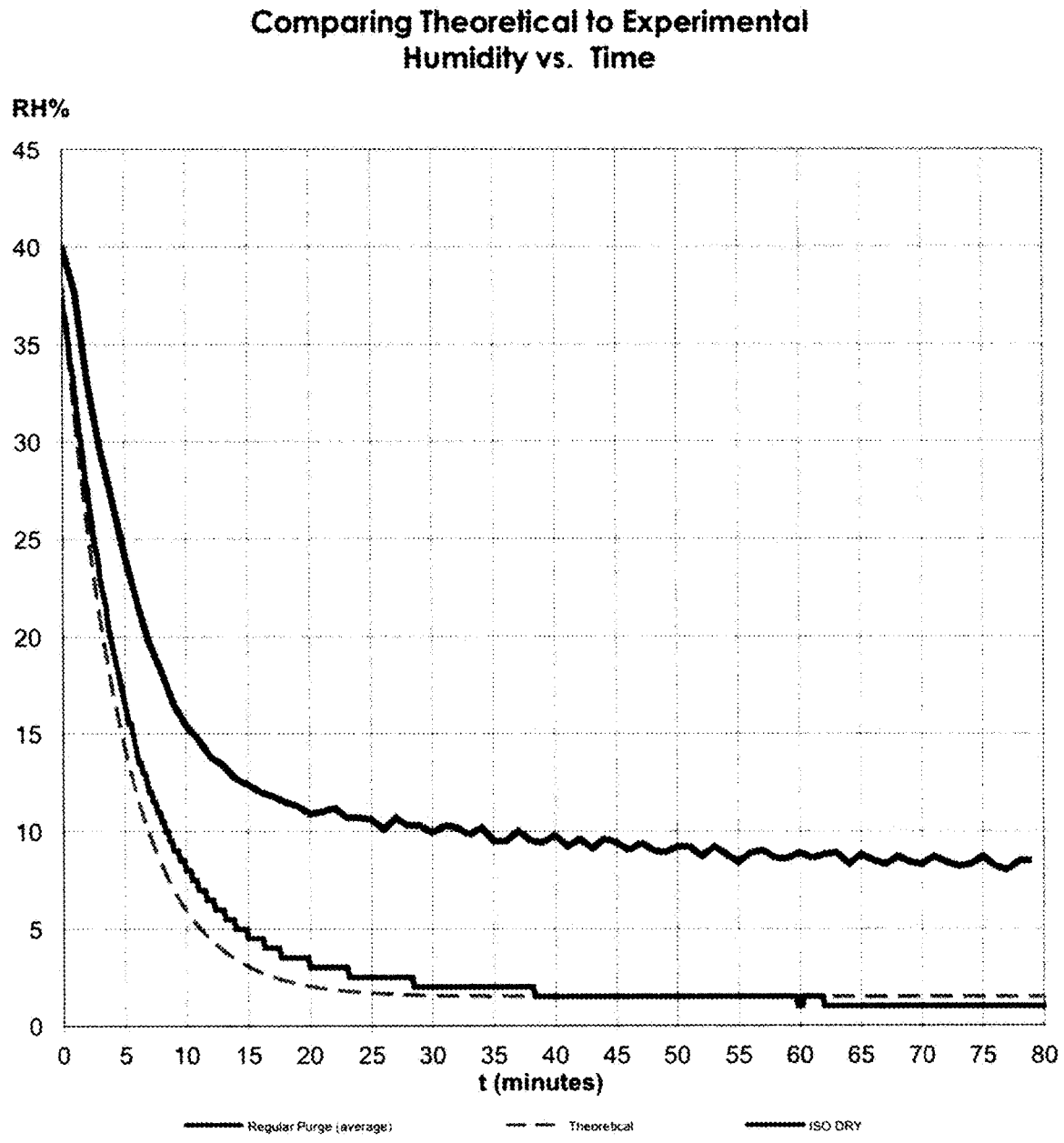
FIG. 31 is a graph showing results of performance test of my desiccator case II.
Figure 32:
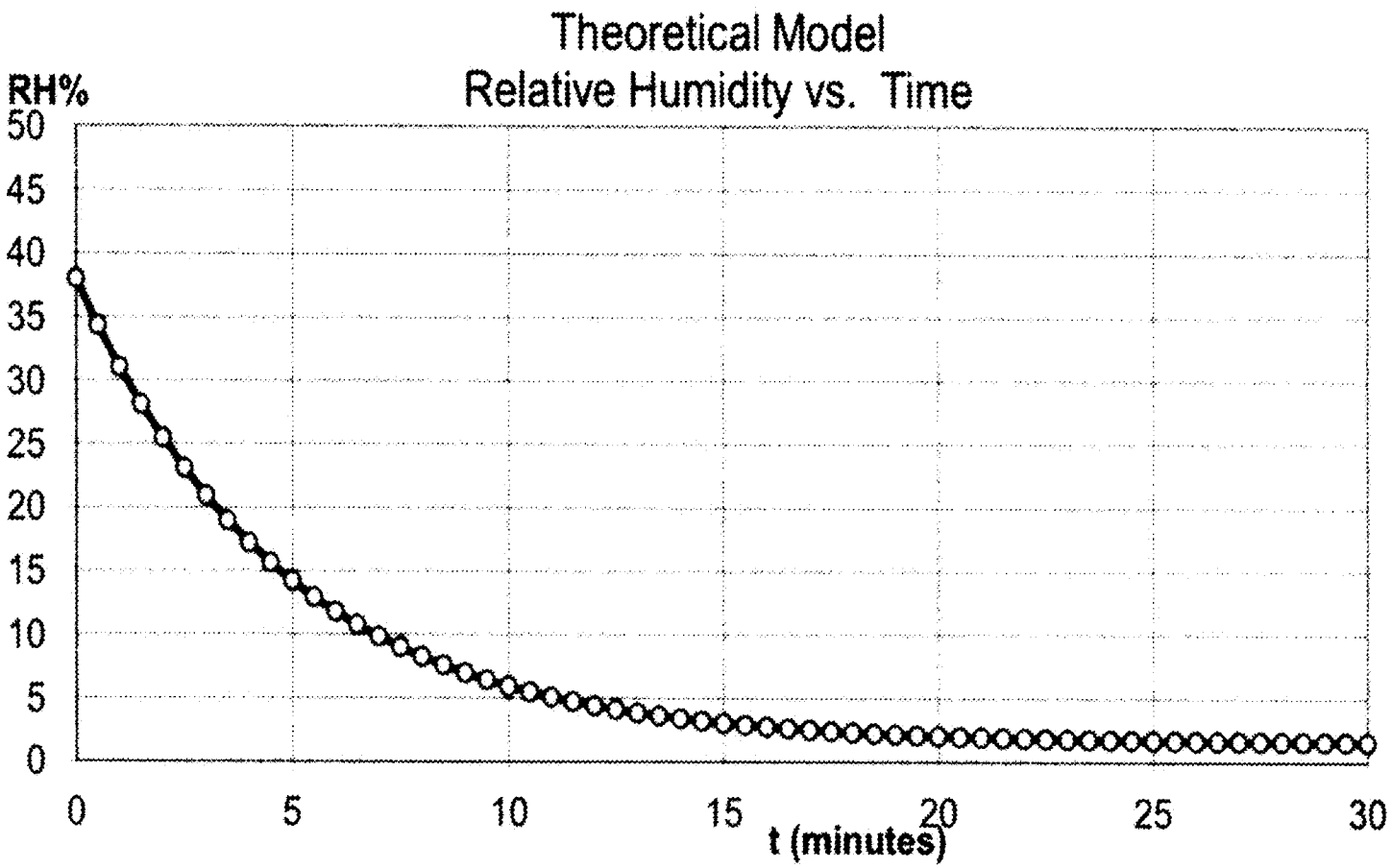
FIG. 32 is a graph showing results of a theoretical model of relative humidity dilution.
Figure 33:
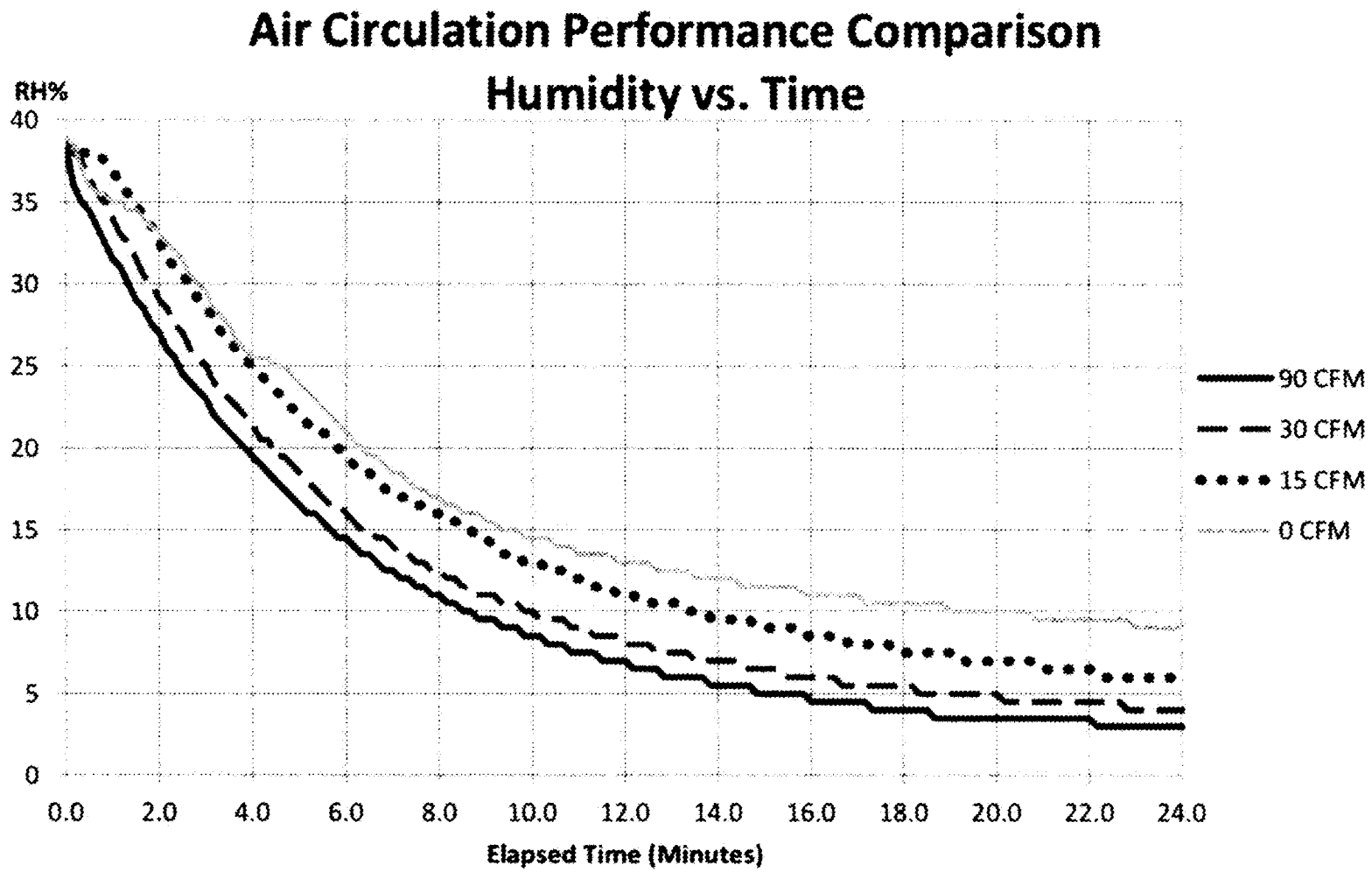
FIG. 33 is a graph showing results of air circulation performance comparison.

The embodiment depicted in FIGS. 1 through 25 is generally designated by the numeral 200 and, as best shown in FIGS. 1 and 2, the components of the desiccator 200 are assembled together to form the vertically aligned chambers 1-5 and the vertical plenum chamber PC2. These components include a top panel TP, a plenum panel PP, a right panel 19, a left panel 20, a door panel 21, plenum rear access panel 22, and a bottom floor panel FL, all of which are made from stainless steel. A series of spaced apart, perforated shelves 3*a* positioned between the right panel 19 and left panel 20 form the perforated floors PF of the chambers 1-5. The shelves 3*a* have fingers 30*b* (FIG. 16) that fit into slots 30 on the inside surfaces of the right panel 19 and left panel 20 and the plenum panel PP to position these shelves horizontally in a spaced apart relationship. The door panel 21 has rectangular opening O2 therein in which the doors D individually fit into snugly, and these doors D are held in position between a rack R and a door latch strip DLS. Catch lift latches are aligned with door handles DH.

A vertical plenum supports 23 and a horizontal plenum supports 24 retain the side panels 19 and 20, plenum panel PP and plenum rear access panel 22 in position. A fan assembly FA (FIG. 14) is attached to the plenum panel PP, which has a pair of circular openings O3 near its upper end. The fan assembly FA comprises a pair of fans F1 and F2 aligned with openings O3, a housing 10, a cover plate 9, and fan guard 11. Opposed wire racks 15 are respectively attached to the inside surface of the right panel 19 and left panel 20. A pair of tube fittings 14 are inserted in small orifices in the top panel TP. These fittings 14 are connected to the purge gas controller 50 (FIG. 35 & FIG. 36) that controls the flow rate and monitors the pressure within the overall chambers 1-5. The automatic bleed valve BV is inserted into the upper end of the left panel 20, and the door sensors DS are adjacent each closed door D, contacting a door upon closing the door. A humidity sensor HS is in the chamber 1 attached to the inside surface of the right panel 19.

FIG. 35

Figure 35:
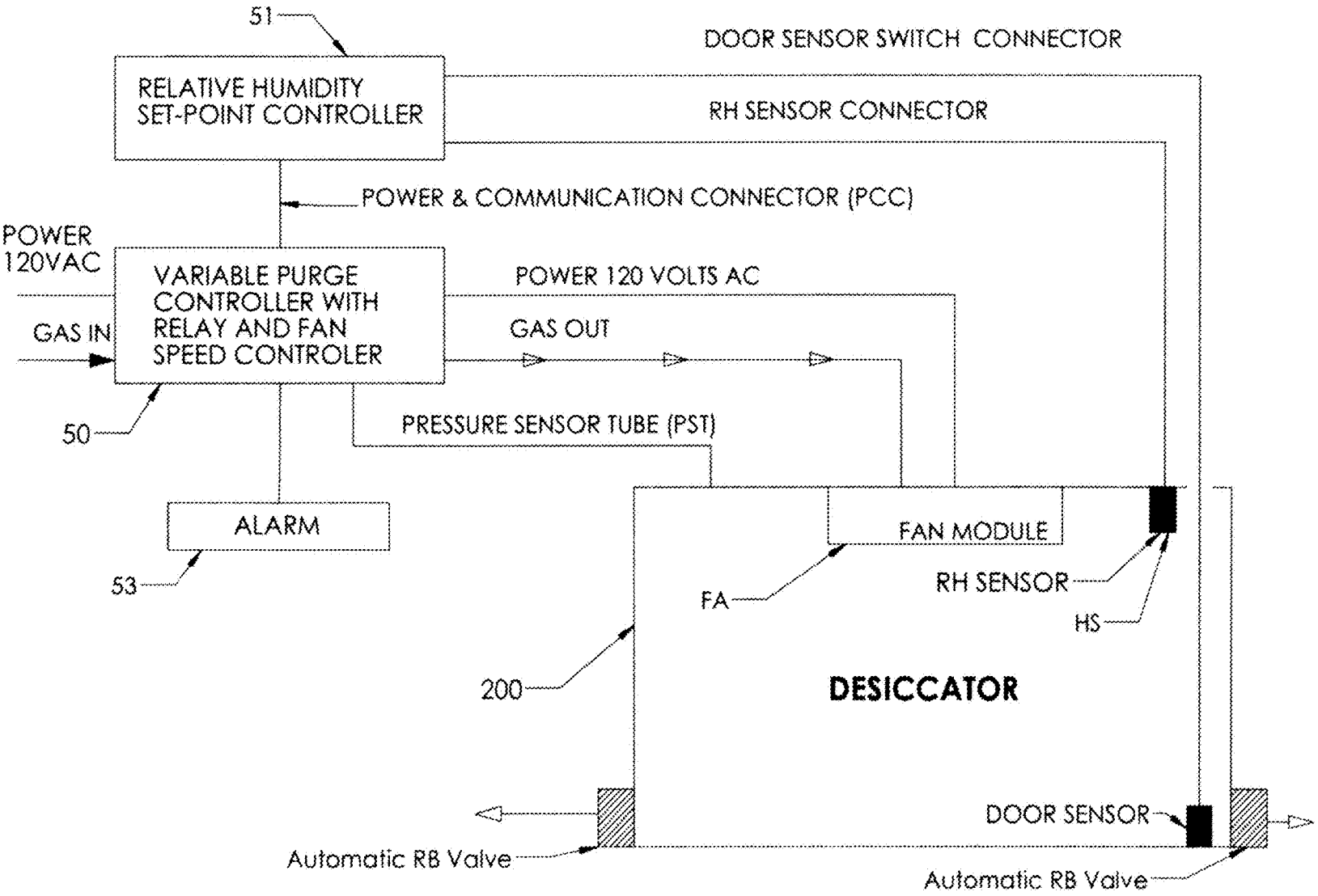
FIG. 35 is a diagram illustrating the control circuit for one embodiment of my desiccator using a 120 volt AC power supply.

As FIG. 35 illustrates, 120 volt AC power is provided to the purge gas controller 50 operably connected to the desiccator 200 through a relay. An output from the purge gas controller 50 provides 120 volt AC power to the fan assembly FA. A pressure sensing tube PST connected between the interior of the desiccator 200 and the desiccator 200 signals the purge gas controller 50 when to increase or decrease the rate of flow of purge gas into the desiccator 200 through the fan assembly FA. The relative humidity set-point controller 51 has a line connected to the humidity sensor HS and another line connected to the door sensor DS. A power and communication connecter PCC places the relative humidity set-point controller 51 in communication in communication with the purge gas controller 50. An audio or visual alarm 53 may be used to indicate any malfunction.

FIG. 36

Figure 36:
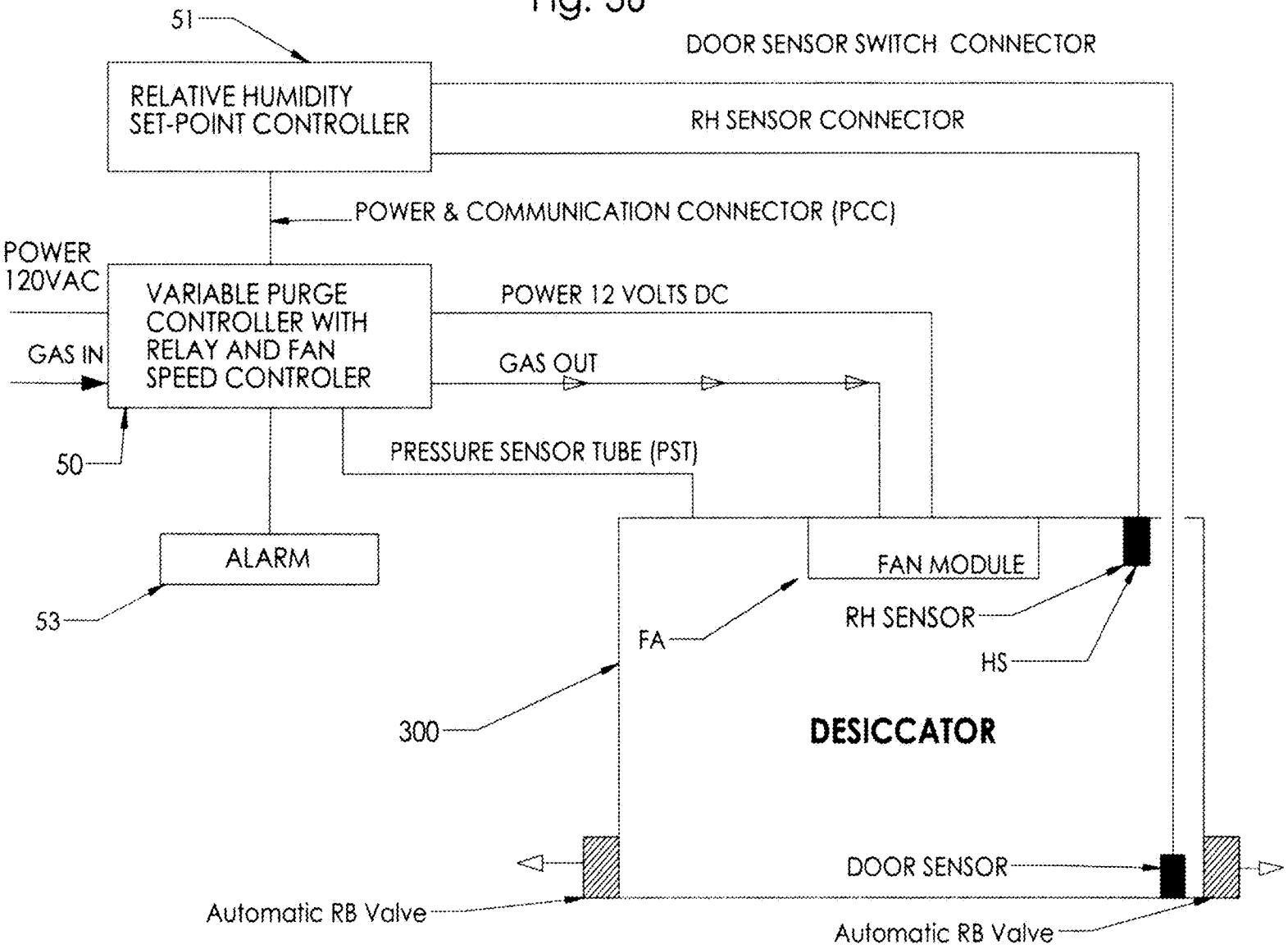
FIG. 36 is a diagram illustrating the control circuit for another embodiment of my desiccator using a 12 volt DC power supply.

FIG. 36 illustrates, a desiccator 300 where the fan assembly FA is powered by 12 volt DC current and includes a variable speed control that enables a user to change the speed of the individual fans F1 and F2.

FIG. 37

Figure 37:
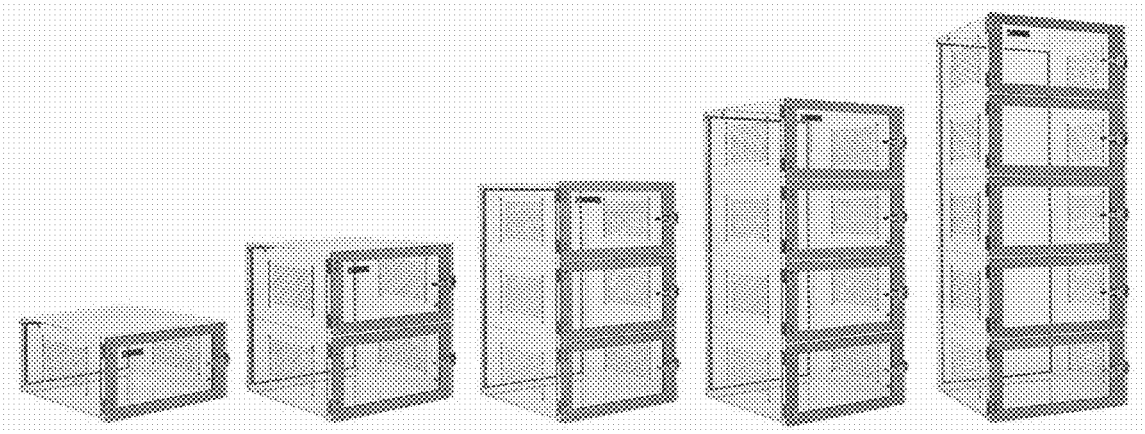
FIG. 37 shows perspective views of different embodiments of my desiccator, from one embodiment using only one single chamber desiccator, and desiccators using different stacking configurations of desiccators employing multiple chambers.
Figure 37:
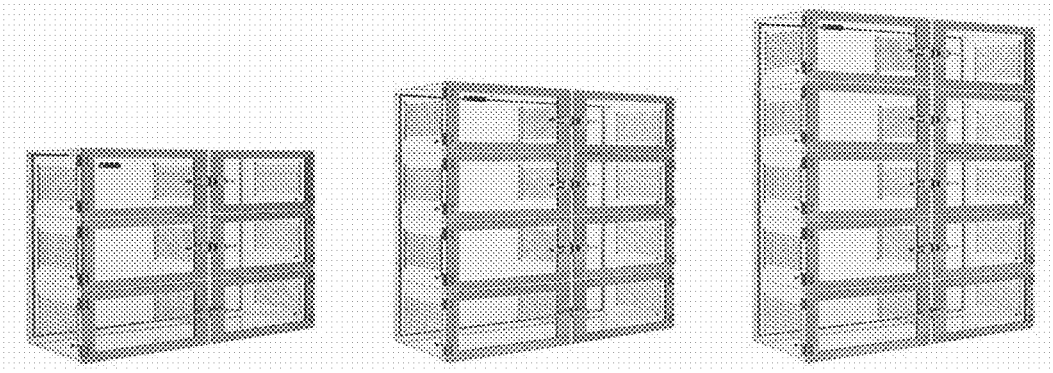

FIG. 37 illustrates various types of multi-chambered desiccators. One embodiment uses only one single chamber desiccator. Other embodiments employ multiple chambers in different stacking configurations.

FIG. 38

FIG. 38 illustrates various component parts used in the above embodiments illustrated.

SCOPE OF THE INVENTION

The above presents a description of the best mode I contemplate of carrying out my desiccator and method and of the manner and process of making and using them, in such full, clear, concise, and exact terms as to enable a person skilled in the art to make and use. My desiccator and method are, however, susceptible to modifications and alternate constructions from the illustrative embodiments discussed above which are fully equivalent. Consequently, it is not the intention to limit my desiccator and method to the particular embodiments disclosed. On the contrary, my intention is to cover all modifications and alternate constructions coming within the spirit and scope of my desiccator and method as generally expressed by the following claims, which particularly point out and distinctly claim the subject matter of my invention:

The invention claimed is:

1. A desiccator comprising:

a humidity sensor within the desiccator, a plurality of chambers in series communication with each other so a desiccating gas flows from one chamber into an adjacent chamber, an inlet through which the desiccating gas is introduced into said chambers at a predetermined flow rate, a door for each chamber that is manually opened and closed, and a position sensor that detects when said door is opened and closed, a purge controller that regulates the flow rate of the desiccating gas through the inlet and into the chambers, introducing the desiccating gas into the chambers to maintain the chambers at a predetermined humidity, a one-way bleed valve that allows gas within the chambers to constantly flow from the desiccator at a rate that is less than said predetermined flow rate, and a fan that, with the chamber doors closed, constantly circulates the gas between the chambers as the desiccating gas is introduced into the desiccator, constantly diluting the gas within the chambers with a fresh supply of the desiccating gas.

2. The desiccator of claim 1 where the purge controller operates to provide a low positive pressure within the chambers when the doors of the chambers are closed and a high flow rate that inhibits moisture or contaminants from entering the chambers upon opening a door of a chamber or upon detection of the relative humidity exceeding the set point.

3. The desiccator of claim 1 where the fan includes a variable speed control mechanism enabling a user to change the speed of the fan.

* * * * *